US008295745B2

(12) United States Patent
Matsuda et al.

(10) Patent No.: US 8,295,745 B2
(45) Date of Patent: Oct. 23, 2012

(54) DEVELOPER CARRYING MEMBER AND DEVELOPING ASSEMBLY

(75) Inventors: Takuma Matsuda, Suntou-gun (JP); Masayoshi Shimamura, Yokohama (JP); Yasutaka Akashi, Yokohama (JP); Satoshi Otake, Numazu (JP); Minoru Ito, Susono (JP); Yoshiyuki Takayama, Tokyo (JP); Kazuhito Wakabayashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/117,391

(22) Filed: May 27, 2011

(65) Prior Publication Data

US 2011/0229218 A1 Sep. 22, 2011

Related U.S. Application Data

(60) Provisional application No. PCT/JP2010/007579, filed on Dec. 27, 2010.

(30) Foreign Application Priority Data

Dec. 28, 2009 (JP) ..... 2009-297565

(51) Int. Cl.
*G03G 15/08* (2006.01)

(52) U.S. Cl. ..... 399/286; 430/123.3

(58) Field of Classification Search ..... 399/265, 399/267, 276, 279, 286; 492/59; 430/123.3
See application file for complete search history.

(56) References Cited

U.S. PATENT DOCUMENTS

| | | | | |
|---|---|---|---|---|
| 4,422,749 | A | 12/1983 | Hoshino et al. | |
| 4,975,745 | A * | 12/1990 | Tanaka et al. | 430/59.2 |
| 5,998,008 | A * | 12/1999 | Shimamura et al. | 428/323 |
| 6,122,473 | A | 9/2000 | Goseki et al. | |
| 6,391,511 | B1 | 5/2002 | Okamoto et al. | |
| 6,687,476 | B2 | 2/2004 | Goseki et al. | |
| 6,873,816 | B2 | 3/2005 | Akashi et al. | |
| 7,223,511 | B2 | 5/2007 | Shimamura et al. | |
| 7,364,791 | B2 | 4/2008 | Shimamura et al. | |
| 7,585,606 | B2 | 9/2009 | Shimamura et al. | |
| 7,638,194 | B2 * | 12/2009 | Fukui et al. | 428/375 |
| 7,727,619 | B2 | 6/2010 | Okamoto et al. | |
| 7,881,648 | B2 * | 2/2011 | Yoshida et al. | 399/286 |
| 8,059,997 | B2 * | 11/2011 | Otake et al. | 399/286 |
| 2010/0028792 | A1 * | 2/2010 | Otake et al. | 430/73 |
| 2011/0268477 | A1 * | 11/2011 | Matsuda et al. | 399/252 |

FOREIGN PATENT DOCUMENTS

| | | | |
|---|---|---|---|
| JP | 11-125966 | A | 5/1995 |
| JP | 2001-132733 | A | 5/2001 |
| JP | 2001-312136 | A | 11/2001 |
| JP | 2003-15403 | A | 1/2003 |
| JP | 2004-126004 | A | 4/2004 |
| JP | 2006-195442 | A | 7/2006 |

OTHER PUBLICATIONS

International Search Report and Written Opinion issued in International Application No. PCT/JP2010/007579.

* cited by examiner

*Primary Examiner* — Robert Beatty
(74) *Attorney, Agent, or Firm* — Fitzpatrick, Cella, Harper & Scinto

(57) ABSTRACT

A developer carrying member and a developing assembly are provided which can stably provide the toner with triboelectric charges, may prevent any problems such as image density decrease, density non-uniformity and spots around images even during running on a large number of sheets, and can enjoy a stable and good developing performance. The developer carrying member has a substrate and a resin layer, and the resin layer containing a thermosetting resin, an acrylic resin having specific units and electroconductive particles.

5 Claims, 3 Drawing Sheets

DEVELOPER CARRYING MEMBER AND DEVELOPING ASSEMBLY

CROSS-REFERENCE TO RELATED APPLICATIONS

This application is a continuation of International Application No. PCT/JP2010/007579, filed Dec. 27, 2010, which claims the benefit of Japanese Patent Application No. 2009-297565, filed Dec. 28, 2009.

BACKGROUND OF THE INVENTION

1. Field of the Invention

This invention relates to a developer carrying member and a developing assembly.

2. Description of the Related Art

In one-component developing methods employed in electrophotography, developers do not contain any carrier, and hence it is unnecessary to change a carrier for new one with deterioration of the carrier. It is also unnecessary to provide developing assemblies with any mechanism for controlling the concentrations of a toner and the carrier, and hence developing assemblies themselves can be made small-size and light-weight.

Now, under needs in recent years for making image quality much higher, Japanese Patent Application Laid-Open No. 2001-312136 discloses a developer carrying member containing in a resin layer as a surface layer a copolymer which contains a quaternary ammonium base as a charge control agent and also a developing assembly which makes use of such a developer carrying member so as to provide the toner with triboelectricity in a higher quantity. The developer carrying member according to Japanese Patent Application Laid-Open No. 2001-312136 can make the resin layer low in its volume resistance because negative-polarity counter ions of the quaternary ammonium base in the resin layer are ionized to make the resin layer have ionic conductivity. As a result of such a low volume resistance, the developer carrying member can prevent ghost and fog from occurring in electrophotographic images, as so considered.

As a result of further studies made by the present inventors on the invention according to Japanese Patent Application Laid-Open No. 2001-312136, they have discovered that any density decrease, density non-uniformity and spots of toner around images may come about in electro-photographic images when the developer carrying member according to Japanese Patent Application Laid-Open No. 2001-312136 is used in a one-component developing system.

Accordingly, the present invention is directed to providing a developer carrying member, and a developing assembly, which can stably provide the toner with triboelectric charges, may less cause any problems such as image density decrease, density non-uniformity and spots around images even during running on a large number of sheets, and can enjoy a stable and good developing performance.

SUMMARY OF THE INVENTION

The present inventors have presumed that one of the causes of bringing about the above problems is any non-uniformity in ionic conductivity that has come because the quaternary ammonium base-containing copolymer capable of providing the surface layer with ionic conductivity is insufficiently compatible with a binder resin. Accordingly, the present inventors have studied the structure of the quaternary ammonium base-containing copolymer so as to improve the quaternary ammonium base-containing copolymer with respect to the binder resin in the surface layer. The present invention is based on such studies.

According to one aspect of the present invention, there is provided a developer carrying member comprising a substrate and a resin layer; wherein said resin layer comprises a thermosetting resin, an acrylic resin having a unit represented by Formula (1) and a unit represented by Formula (2), and electroconductive particles:

(1)

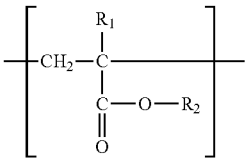

where, in Formula (1), $R_1$ represents a hydrogen atom or a methyl group, and $R_2$ represents an alkyl group having 8 to 18 carbon atoms; and (2)

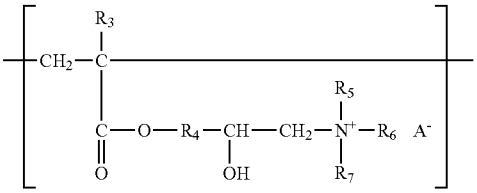

where, in Formula (2), $R_3$ represents a hydrogen atom or a methyl group; $R_4$ represents an alkylene group having 1 to 4 carbon atom(s); one or two or more groups of $R_5$ to $R_7$ represents or each independently represent any group selected from an alkyl group having 4 to 18 carbon atoms and a hydroxyalkyl group having 4 to 18 carbon atoms; of these $R_5$ to $R_7$, a group or groups which is/are not the alkyl group(s) having 4 to 18 carbon atoms or hydroxyalkyl group(s) having 4 to 18 carbon atoms represents or each independently represent any group selected from an alkyl group having 1 to 3 carbon atom(s) and a hydroxyalkyl group having 1 to 3 carbon atom(s); and $A^-$ represents an anion.

According to the present invention, a developing assembly is further provided which comprises a negatively chargeable developer having toner particles, a container holding the developer therein and a developer carrying member for carrying and transporting thereon the developer held in the container, and wherein the developing assembly transports, while forming a developer layer on the developer carrying member by means of a developer layer thickness control member, the developer on the developer carrying member to a developing area facing an electrostatic latent image bearing member and develops an electrostatic latent image the electrostatic latent image bearing member has; and the developer carrying member is the above developer carrying member.

DESCRIPTION OF THE EMBODIMENTS

Figure 1A:
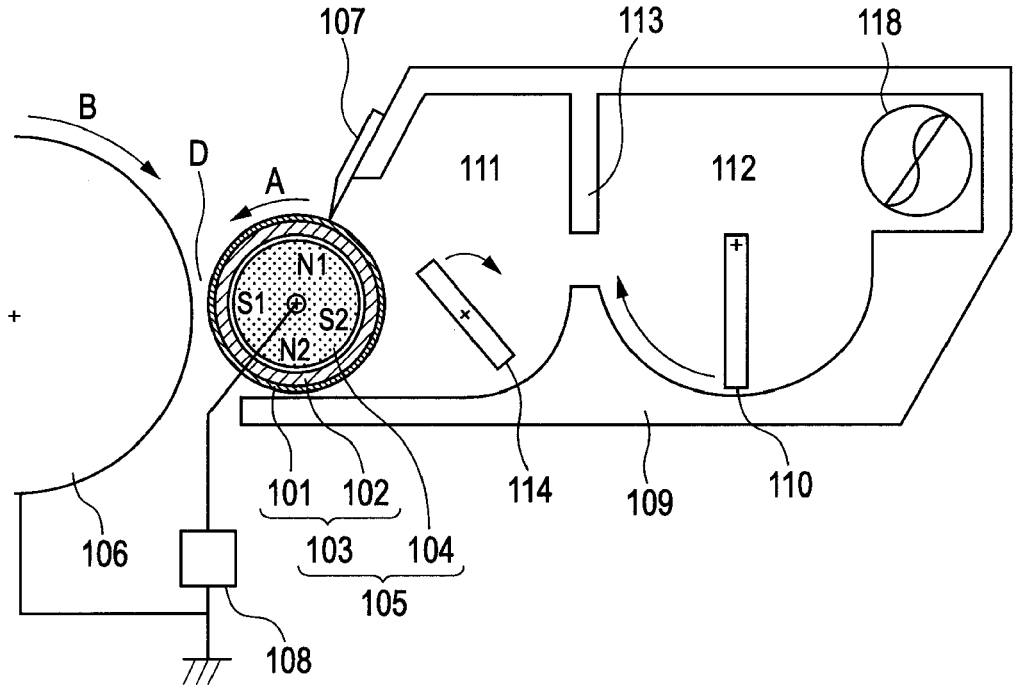
FIG. 1A is a sectional view showing an embodiment of the developing assembly according to the present invention.

The developer carrying member according to the present invention has a substrate and a resin layer. The resin layer contains a thermosetting resin, an acrylic resin having at least a unit represented by Formula (1) and a unit represented by Formula (2), and electroconductive particles. The acrylic resin is contained in the resin layer, and this enables a toner with negative triboelectric chargeability to be provided with triboelectricity in an improved quantity. Further, the acrylic resin has a quaternary ammonium base, and hence it has ionic conductivity and can low and uniformly control the volume resistivity of the resin layer. As the result, the toner can be prevented from being triboelectrically charged in excess throughout running on a large number of sheets, the image density can be stable with ease, and the spots around images can easily be kept from occurring.

The acrylic resin has at least a unit represented by Formula (1) and a unit represented by Formula (2).

(1)

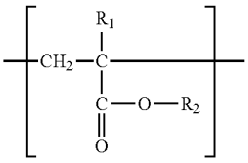

In Formula (1), $R_1$ represents a hydrogen atom or a methyl group, and $R_2$ represents an alkyl group having 8 to 18 carbon atoms. Inasmuch as the $R_2$ in Formula (1) is such a long-chain alkyl group having 8 to 18 carbon atoms, the acrylic resin according to the present invention can have a low polarity, so that the acrylic resin can be improved in its compatibility with the thermosetting resin; the latter also having a low polarity. This makes the acrylic resin uniformly present in the resin layer, and enables the toner to be provided with uniform triboelectric charges. Also, the dispersibility of a pigment such as electroconductive particles in the resin layer is improved, and hence resistance distribution can be so uniform that the toner can be kept from locally triboelectrically charged in excess.

As the unit represented by the above Formula (1), a preferable form is a unit in which $R_1$ is a methyl group and $R_2$ is a long-chain alkyl group selected from a decyl group, an undecyl group, a dodecyl group, a tridecyl group and a tetradecyl group.

(2)

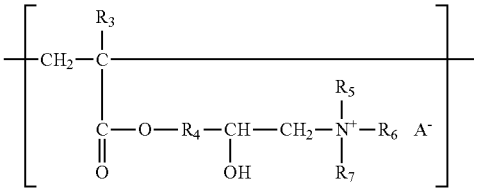

In Formula (2), $R_3$ represents a hydrogen atom or a methyl group; $R_4$ represents an alkylene group having 1 to 4 carbon atom(s). One or two or more groups of $R_5$ to $R_7$ represents or each independently represent any group selected from an alkyl group having 4 to 18 carbon atoms and a hydroxyalkyl group having 4 to 18 carbon atoms. Of these $R_5$ to $R_7$, a group or groups which is/are not the alkyl group(s) having 4 to 18 carbon atoms or hydroxyalkyl group(s) having 4 to 18 carbon atoms represents or each independently represent any group selected from an alkyl group having 1 to 3 carbon atom(s) and a hydroxyalkyl group having 1 to 3 carbon atom(s). $A^-$ represents an anion.

The unit represented by the above Formula (2) has such a long-chain alkyl group(s) having 4 to 18 carbon atoms or the hydroxyalkyl group(s) having 4 to 18 carbon atoms, and this enables the charging site cationic units to be uniformly present in the thermosetting resin to provide the toner with uniform triboelectric charges. Also, the presence of such alkyl group(s) or hydroxyalkyl group(s) makes the acrylic resin highly hydrophobic, so that the acrylic resin shows a tendency of being more present on the surface of the resin layer depending on a difference in polarity between the acrylic resin and the thermosetting resin.

The unit represented by the above Formula (2) also has cationic properties, and hence the resin layer surface can have the effect of bringing an improvement in negative triboelectric charge-providing ability to the toner.

The unit represented by the above Formula (2) further has a hydroxyl group in the vicinity of the quaternary ammonium base, and this enables the toner with negative triboelectric chargeability to be provided with triboelectricity in a more improved quantity. The reason therefor is uncertain, and it is considered that having the hydroxyl group has made the N element of the quaternary ammonium base change in its polarity and, as a result thereof, the acrylic resin has brought an improvement in negative triboelectric charge-providing ability to the toner.

As the unit represented by the above Formula (2), a preferable form is that $R_3$ is a methyl group, $R_4$ is a methylene group or an ethylene group, and also one or two or more groups of $R_5$, $R_6$ and $R_7$ is or are each independently any group selected from an alkyl group having 4 to 18 carbon atoms and a hydroxyalkyl group having 4 to 18 carbon atoms. Here, where, of these $R_5$, $R_6$ and $R_7$, one group or two groups which is/are not any group(s) selected from the alkyl group(s) having 4 to 18 carbon atoms and the hydroxyalkyl group(s) having 4 to 18 carbon atoms, such a group or groups is or are each independently any group selected from an alkyl group having 1 to 3 carbon atom(s) and a hydroxyalkyl group having 1 to 3 carbon atom(s).

Specific examples of the long-chain alkyl group having 8 to 14 carbon atoms are given below: An octyl group, a nonyl group, a decyl group, an undecyl group, a dodecyl group, a tridecyl group and a tetradecyl group.

In the present invention, the hydroxyalkyl group having 8 to 14 carbon atoms refers to a group consisting of an oxygen atom bonded to the nitrogen atom in Formula (2) and an alkyl group having 8 to 14 carbon atoms that is bonded to the oxygen atom. Specific examples of such an alkyl group having 8 to 14 carbon atoms are given below: A hydroxyoctyl group, a hydroxynonyl group, a hydroxydecyl group, a hydroxyundecyl group, a hydroxydodecyl group, a hydroxytridecyl group and a hydroxytetradecyl group.

On the other hand, if at least one of $R_5$, $R_6$ and $R_7$ is an alkyl group having 19 or more carbon atoms, the acrylic resin may come so highly crystalline as to tend to result in having a low compatibility with the thermosetting resin and a solvent. As the result, the thermosetting resin and the acrylic resin may tend to undergo phase separation.

The $A^-$ in Formula (2) is an anion of halogens, inorganic acids such as hydrochloric acid, hydrobromic acid, sulfuric acid, phosphoric acid and nitric acid and organic acids such as carboxylic acids and sulfonic acids. It may preferably be a methylsulfonate ion or a p-toluenesulfonate ion, which can bring a further improvement in negative triboelectric charge-providing ability to the toner.

The acrylic resin usable in the present invention may be produced by copolymerizing an acrylic monomer and an acrylic monomer having a quaternary ammonium base.

The former acrylic monomer may include a monomer represented by the following Formula (3).

(3)

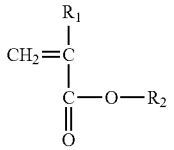

In the above Formula (3), $R_1$ and $R_2$ represents the same ones as those for $R_1$ and $R_2$ in the unit represented by the above Formula (1).

The latter acrylic monomer having a quaternary ammonium base may include a monomer represented by the following formula (4).

(4)

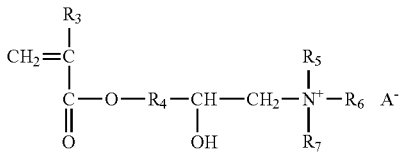

In the above Formula (4), $R_3$ to $R_7$ and $A^-$ are each as defined for $R_3$ to $R_7$ and $A^-$ in the unit represented by the above Formula (2).

The acrylic resin according to the present invention, making use of the monomers represented by the above Formulae (3) and (4) and so forth may be produced by bulk polymerization, solution polymerization, emulsion polymerization or suspension polymerization. In particular, solution polymerization is preferred in view of an advantage that the reaction can be controlled with ease.

As a solvent used in the solution polymerization, it may preferably be a lower alcohol such as methanol, ethanol, n-butanol or isopropyl alcohol. Any other solvent may optionally be mixed. Such other solvent that may be used in the form of a mixture with the lower alcohol may include the following: Xylene, toluene, ethyl acetate, isobutyl acetate, methyl ethyl ketone, methyl isobutyl ketone, N,N-dimethylformamide and dimethylformamide.

As the mass ratio of such a solvent to the monomer components in carrying out the solution polymerization, it may preferably be carried out using 25 parts by mass or more to 400 parts by mass or less of the solvent, based on 100 parts by mass of the monomer components. This is preferable in order to control the product to have an appropriate viscosity.

The solution polymerization may be carried out by, e.g., heating the monomers in the presence of a polymerization initiator, in an atmosphere of an inert gas and at a temperature of from 50° C. or more to 100° C. or less.

Specific examples of the polymerization initiator are given below: t-Butyl peroxy-2-ethylhexanoate, cumyl perpivarate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis-(2-methylbutyronitrile), 2,2'-azobis(2,4-dimethylvaleronitrile), 2,2'-azobis(4-methoxy-2,4-dimethylvaleronitrile), and dimethyl 2,2'-azobis(2-methyl propionate).

The polymerization initiator may be used alone or in combination of two or more types of initiators. Usually, the polymerization is initiated with addition of the polymerization initiator to a monomer solution. However, in order to make any unreacted monomers less remain, part of the polymerization initiator may be added on the way of the polymerization. A method may also be employed in which the polymerization is accelerated by irradiation with ultraviolet rays or electron rays. These methods may also be combined.

The polymerization initiator may preferably be used in an amount of from 0.05 part by mass or more to 30 parts by mass or less, based on 100 parts by mass of the copolymerization monomer components. This is preferable in view of the reduction of any residual monomers and the controlling of molecular weight of the acrylic resin. Its amount may much preferably be from 0.1 part by mass or more to 15 parts by mass or less. As temperature of the polymerization reaction, it may be set in accordance with the solvent, polymerization initiator and monomer components to be used. The reaction may be carried out at a temperature of from 40° C. or more to 150° C. or less, and this is preferable in view of stable progress of the polymerization reaction.

As the monomer represented by the above Formula (4), a monomer may be used which has been formed by subjecting a glycidyl group-containing ester monomer represented by the following Formula (5), to ring-opening reaction with a quaternary ammonium base represented by the following Formula (6).

(5)

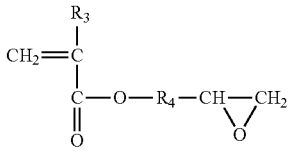

In the above Formula (5), $R_3$ represents a hydrogen atom or a methyl group, and $R_4$ represents an alkylene group having 1 to 4 carbon atom(s).

(6)

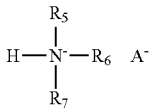

In the above Formula (6), $R_5$, $R_6$, $R_7$ and $A^-$ are each as defined for $R_5$, $R_6$, $R_7$ and $A^-$ in the above Formula (2). Further, the reaction of these monomers may be carried out by, e.g., heating the monomers and the quaternary ammonium base in a solvent at a temperature of from 50° C. or more to 120° C. or less.

A monomer may also be used which has been formed by allowing the monomer represented by the above Formula (5), to react with an organic amine in the presence of an acid component.

The organic amine may include as specific examples thereof the following: Tertiary amines such as trimethylamine, triethylamine, trioctylamine, dimethylbutylamine, dimethyloctylamine, dimethyllaurylamine, dimethylstearylamine, dilaurylmonomethylamine and dimethylbehenylamine; secondary amines such as dimethylamine, diethylamine, methylbutylamine, methyloctylamine, methyllaurylamine and methylstearylamine; and ethanolamines such as dimethylethanolamine, diethylethanolamine and dimethylaminohexanol.

The acid component may include as specific examples thereof the following: Hydrogen halides such as hydrogen bromide and hydrogen chloride; alkyl halides such as methyl bromide, methyl chloride, butyl bromide, butyl chloride, octyl bromide, octyl chloride, lauryl bromide, lauryl chloride, octadecyl bromide and octadecyl chloride; and organic acids such as methylsulfonic acid and p-toluenesulfonic acid.

The acrylic resin according to the present invention, having the desired quaternary ammonium base, may also be obtained by copolymerizing the monomer represented by the above Formula (3) and the monomer represented by the above Formula (5) and thereafter subjecting the resultant copolymer to ring-opening reaction with the above organic amine. Besides, the acrylic resin according to the present invention may also be obtained in the following way. That is, the monomer represented by the above Formula (5) quaternized with an organic amine such as trimethylamine in a hydrochloric acid solvent, and thereafter the product obtained is copolymerized with the monomer represented by the above Formula (3). The acrylic copolymer obtained, having the quaternary ammonium base, is treated with an acid such as p-toluenesulfonic acid or hydroxynaphthalenesulfonic acid to effect counter ion exchange.

The respective units in the above acrylic resin may preferably be in such a compositional proportion that, where the acrylic resin has A-moles of the unit represented by Formula (1) and B-moles of the unit represented by Formula (2), the value of B/(A+B) is preferably from 0.2 or more to 0.8 or less.

Inasmuch as the value of B/(A+B) is not less than 0.2, the acrylic resin is improved in its negative charge-providing ability. Also, the effect of ionic conduction that is attributable to the quaternary ammonium salt structure can be enhanced with ease, and hence any ghost can more easily be kept from occurring. Inasmuch as the value of B/(A+B) is not more than 0.8, this makes the acrylic resin according to the present invention better compatible with the thermosetting resin to make the former more uniformly present in the resin layer. Further, this makes well dispersible the electroconductive particles that are to be present in the resin layer.

Incidentally, where the unit of Formula (1) and the unit of Formula (1) are each contained in the acrylic resin in plural kind, the total of compositional proportions for two or more units of Formula (1) and the total of compositional proportions for two or more units of Formula (2) are represented by A and B, respectively.

The acrylic resin may contain a unit(s) other than the unit of Formula (1) and unit of Formula (2). Such other unit(s) in the acrylic resin may preferably be in a polymerization proportion of 30 mole % or less. Inasmuch as the other unit(s) is/are in a polymerization proportion of 30 mole % or less, the effect due to the introduction of the unit of Formula (1) and unit of Formula (2) can more surely be obtained.

In the resin layer, the acrylic resin according to the present invention may preferably be contained in an amount of approximately from 1 part by mass or more to 30 parts by mass or less, based on 100 parts by mass of the thermosetting resin. Inasmuch as its content is within this range, the performance to control the triboelectric charging of toner by the developer carrying member according to the present invention can more sufficiently be brought out. Also, the distribution of triboelectric charge quantity that is to be given in the toner by the developer carrying member according to the present invention can be made more uniform.

In addition to the above acrylic resin, the resin layer according to the present invention also contains a thermosetting resin. Containing the thermosetting resin as a binder resin makes the resin layer improved in durability and environmental stability.

As the thermosetting resin, a phenol resin, a melamine resin, a urea resin or a benzoguanamine resin is preferred in view of toughness and durability. In particular, on a point of improvement in wear resistance of the resin layer, the phenol resin is preferred as promising superior environmental stability and also promising superior compatibility with the above acrylic resin. Also, of these thermosetting resins, a type that is soluble in lower alcohols, in particular, alcohols such as methanol, ethanol, propyl alcohol and butanol is preferred because of its good compatibility with the acrylic resin according to the present invention in a coating material when the resin layer is formed.

The resin layer contains electroconductive particles including the following, in order to control the resistance value, i.e., electrical conductivity, of the resin layer.

Specific examples of the electroconductive particles are given below; fine powder of metals (such as aluminum, copper, nickel and silver), particles of metal oxides (such as antimony oxide, indium oxide, tin oxide, titanium oxide, zinc oxide, molybdenum oxide and potassium titanate), and carbon fibers, carbon black (such as furnace black, lamp black, thermal black, acetylene black and channel black) and graphite.

Of these, carbon black, in particular, amorphous carbon may preferably be used. This is because the carbon black has especially superior electrical conductivity, may be filled in high-molecular materials to provide them with conductivity, and can achieve any desired conductivity to a certain degree by merely controlling its amount when added. Two or more types of these electroconductive particles may also be used to control the volume resistivity of the resin layer. In the case when two or more types of the electroconductive particles are used, carbon black and graphite particles are preferred. The use of carbon black and graphite particles as the electroconductive particles enables a resin layer to be obtained which has uniform volume resistance and also good conductivity. Further, the developer carrying member can be made to have a certain surface roughness, and hence the triboelectric chargeability of the toner on the developer carrying member can uniformly be controlled with ease.

Such electroconductive particles may also preferably be added in an amount ranging from 20 parts by mass to 100 parts by mass or less, based on 100 parts by mass of the binder resin. As long as they are in an amount not less than 1 part by mass, the resistance value of the resin layer can be made low to the desired level. As long as they are in an amount of not more than 100 parts by mass, the resin layer can be kept from having a low strength (wear resistance) especially where a fine powder having particle size of submicron order is used.

The resin layer may preferably have a volume resistivity of $10^4$ Ω·cm or less, and particularly preferably from $10^{-3}$ Ω·cm or more to $10^3$ Ω·cm or less. As long as the resin layer has volume resistivity within the above range, this is effective in better keeping any ghost from occurring in electrophotographic images.

The resin layer may preferably have, as its surface roughness, an arithmetic-mean roughness Ra (JIS B 0601-2001) of commonly from 0.3 μm to 2.5 μm. Inasmuch as it has Ra within this range, any image density decrease due to a shortage of the level of transport of the toner and any faulty images due to non-uniformity of the toner coat layer on the developer carrying member can be kept from occurring. The level of transport of the toner thereon can also be made stabler, so that the toner thereon can triboelectrically be so charged as to be uniform in distribution of its triboelectric charge quantity.

As the surface roughness of the resin layer, the value of measurement made by the measuring method according to JIS B 0601 (2001) may be employed. As a method by which the surface roughness of the resin layer is controlled to the desired value, a method is available in which the substrate on which the resin layer is to be formed is sand-blasted to provide it with surface roughness and the resin layer is formed thereon, or a method in which the resin layer is incorporated with unevenness-providing particles to attain the surface roughness. From the viewpoint of the permanence of the surface roughness and the controlling of the surface roughness at a low cost, the method in which the resin layer is incorporated with unevenness-providing particles is preferred. Such addition of unevenness-providing particles makes the surface of the resin layer of the developer carrying member retain an appropriate surface roughness to improve the toner transport performance, and provides more opportunities of contact between the toner and the resin layer to facilitate improvement in triboelectric chargeability.

The unevenness-providing particles may preferably have a volume average particle diameter of from 1 μm to 20 μm, and particularly preferably from 3 μm to 15 μm, in order to form appropriate unevenness on the resin layer surface. Inasmuch as the particles have volume average particle diameter within this range, the resin layer can be provided with an appropriate surface roughness even where the particles are in a small content. Also, the resin layer can be kept from having so non-uniform surface roughness and so great roughness as to make the toner have insufficient triboelectric charges. As such unevenness-providing particles, resin particles, metal oxide particles or carbide particles may be used. As the shape of the unevenness-providing particles, a spherical shape or the like shape is preferable because the particles can uniformly be dispersed in the resin layer with ease. The volume average particle diameter of the unevenness-providing particles may employ the measured value found by measurement with a laser diffraction particle size distribution meter.

How to form the resin layer is described next. The resin layer may be formed by, e.g., dispersing and mixing the components of the resin layer in a solvent to make them into a coating material and coating the substrate with the coating material, followed by drying to set or harden. In first dispersing and mixing the components of the resin layer in a solvent as above, any known dispersion apparatus may preferable be used. As the method of coating the substrate with the coating material obtained, too, any known method may be used, and, in particular, spraying is preferable because the components in the resin layer can be made uniform. Further, the resin layer may also preferably have a layer thickness of 50 μm or less, particularly 40 μm or less, and more particularly from 4 μm to 30 μm, because it is easy to form the layer in a uniform layer thickness.

The substrate of the developer carrying member may be a non-magnetic metal or alloy such as aluminum, stainless steel or brass, molded in a cylindrical shape or columnar shape and thereafter subjected to working such as abrasion or grinding, which may preferably be used.

Developer Carrying Member

The developing assembly according to the present invention has a negatively chargeable developer having toner particles, a container holding the developer therein, the developer carrying member described above, and a developer layer thickness control member which forms a developer layer on the developer carrying member.

This developing assembly may be used in any of a non-contact developing assembly and a contact developing assembly which make use of a magnetic one-component developer or non-magnetic one-component developer and a developing assembly making use of a two-component developer. Of these, it may particularly preferably be used in the non-contact developing assembly, such as a magnetic one-component non-contact developing assembly or a non-magnetic one-component non-contact developing assembly, having a tendency to easily cause non-uniformity in triboelectric charge quantity of the developer on the developer carrying member.

FIG. 1A is a sectional view of a magnetic one-component non-contact developing assembly making use of a developing assembly according to an embodiment of the present invention. This developing assembly has a container (developer container 109) for holding a developer therein and a developer carrying member 105 for carrying and transporting thereon a magnetic one-component developer (not shown) (also called a magnetic toner) having magnetic toner particles, held in the container.

The developer carrying member 105 is provided with a developing sleeve 103 having a metal cylindrical tube that is a substrate 102 and provided thereon a resin layer 101. Also, inside the developing sleeve, a magnet (a magnet roller) 104 is provided so that a magnetic toner can magnetically be held on the sleeve surface.

Meanwhile, an electrostatic latent image bearing member (e.g., a photosensitive drum) 106 holding thereon an electrostatic latent image is rotated in the direction of an arrow B. Then, in a developing area D where the developer carrying member 105 and the photosensitive drum 106 face each other, the magnetic toner on the developer carrying member 105 is caused to adhere to the electrostatic latent image so that a magnetic toner image may be formed.

A developing method in such a developing assembly is described below. The magnetic toner is sent into the developer container 109 from a developer supply container (not shown) via a developer feed member (such as a screw) 118. The developer container 109 is divided into a first chamber 112 and a second chamber 111, where the magnetic toner having been sent into the first chamber 112 is sent to the second chamber 111 by the aid of an agitating transport member 110, passing through an opening formed by the developer container 109 and a partition member 113. The second chamber 111 is provided therein with an agitating member 114.

The developer container 109 is fitted with a magnetic blade 107, the developer layer thickness control member, in such a way as to face the developer carrying member 105 leaving a gap of from about 50 μm or more to about 500 μm or less between them. The magnetic line of force exerted from a magnetic pole N1 of the magnet roller 104 is converged to the gap at the magnetic blade, where the developer carrying member is rotated in the direction of an arrow A to form on the developer carrying member 105 a thin layer of the magnetic toner. Incidentally, a non-magnetic developer layer thickness control member may also be used in place of the magnetic blade 107. The magnetic toner gains triboelectric charges which enable development of the electrostatic latent image formed on the photosensitive drum 106, as a result of the friction between toner particles one another and between the magnetic toner and the resin layer 101 at the surface of the developer carrying member 105. The thickness of the magnetic toner thin layer thus formed on the developer carrying member 105 may preferably be much smaller than the minimum gap between the developer carrying member 105 and the photosensitive drum 106 in the developing area D.

In order to cause the magnetic toner carried on the developer carrying member 105, to fly to the electrostatic latent image formed on the photosensitive drum to develop this latent image, a development bias voltage may preferably be applied to the developer carrying member 105 through a development bias power source 108.

When a direct-current voltage is used as the development bias voltage to be applied to the developer carrying member 105, a voltage is preferable which corresponds to a value intermediate between the potential at electrostatic latent image areas and the potential at back ground areas. In order to enhance the density of the developed image or improve the gradation thereof, an alternating bias voltage may be applied to the developer carrying member 105 to form in the developing area D a vibrating electric field whose direction alternately reverses. In such a case, too, an alternating bias voltage formed by superimposing thereon a direct-current voltage component corresponding to a value intermediate between the potential at electrostatic latent image areas and the potential at back ground areas is preferable as the voltage to be applied to the developer carrying member 105.

Here, in the case of regular development, where the magnetic toner is attracted to an electrostatic latent image having high potential, a magnetic toner triboelectrically chargeable to a polarity reverse to the polarity of the electrostatic latent image is used. In the case of reverse development, where the magnetic toner is attracted to an electrostatic latent image having low potential, a magnetic toner chargeable to the same polarity as the polarity of the electrostatic latent image is used. What is herein meant by the high potential or the low potential is expression made by the absolute value.

Figure 1B:
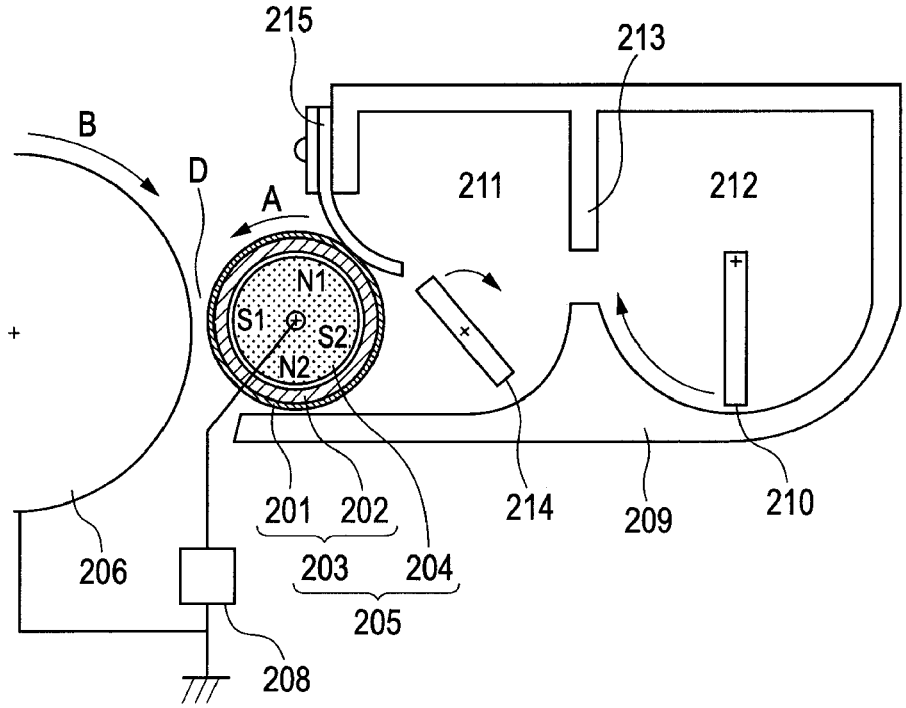
FIG. 1B is a sectional view showing an embodiment of the developing assembly according to the present invention.

FIG. 1B is a sectional view of a magnetic one-component non-contact developing assembly making use of a developing assembly according to another embodiment of the present invention. This developing assembly is provided with an elastic blade 215. The elastic blade 215 is brought into touch with or pressed against a developer carrying member 205 through a toner, and the toner is formed in a thin layer on the developer carrying member 205, undergoing a stronger control than the non-contact developing assembly shown in FIG. 1A.

In this developing assembly, the toner tends to be affected by any non-uniformity in electrical conductivity of the developer carrying member surface. That is, the toner layer on the developer carrying member tends to become non-uniform in triboelectric charge quantity, so that a broad triboelectric charge distribution may tend to result. However, where the developer carrying member described above is used for such a developing assembly, the toner can be made to have a sharper distribution of triboelectric charge quantity. Here, the elastic blade 215 may be brought into touch with the developer carrying member 205 at a touch pressure of approximately from 4.9 N/m or more to 49 N/m or less as linear pressure.

The above examples are magnetic one-component non-contact types. Any of the above developing assemblies, however, may also be used in a magnetic one-component contact developing assembly, in which the toner layer on the developer carrying member is formed in a thickness larger than the distance between the developer carrying member and the photosensitive drum in the developing area D.

Figure 2:
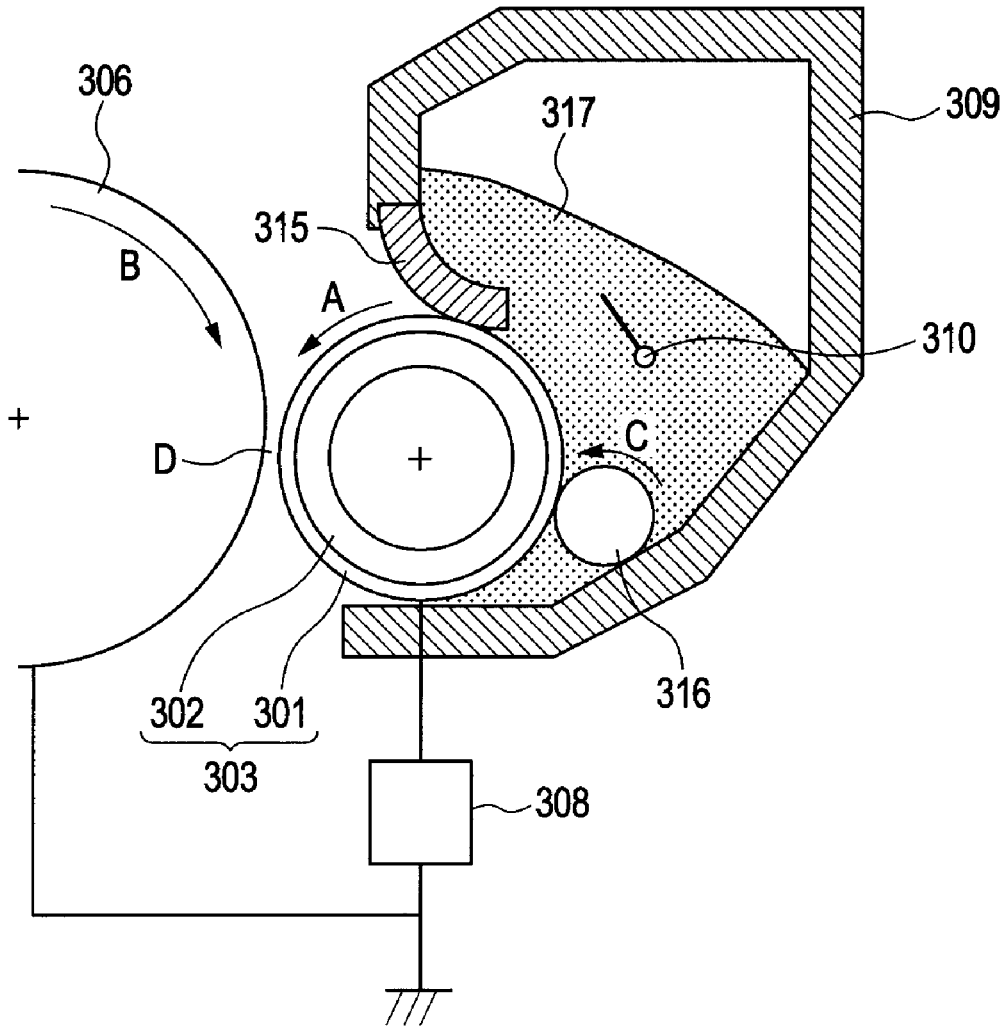
FIG. 2 is a sectional view showing another embodiment of the developing assembly according to the present invention.

FIG. 2 is a sectional view of a non-magnetic one-component non-contact developing assembly, which uses a non-magnetic toner; the assembly making use of a developing assembly according to another embodiment of the present invention. In this developing assembly, the electrostatic latent image bearing member carrying the electrostatic latent image thereon, e.g., a photosensitive drum 306 is rotated in the direction of an arrow B. A developing sleeve 303 as the developer carrying member is constituted of a substrate (a metal cylindrical tube) 302 and a resin layer 301 formed on its surface. As the substrate, a columnar member may also be used in place of the metal cylindrical tube, and a non-magnetic one-component developer (non-magnetic toner) is used, where the substrate 302 is not internally provided therein with any magnet.

Developing Method

A developing method making use of the developing assembly described above is described below. A developer container 309 is provided therein with an agitating transport member 310 for agitating and transporting a non-magnetic one-component developer 317 (also called a non-magnetic toner). The developer container is further provided therein with a developer feeding and stripping member (also called "RS roller") 316 in contact with the developing sleeve 303, which member is to feed the non-magnetic toner to the developing sleeve 303 and also strip off any non-magnetic toner remaining on the surface of the developing sleeve 303 after development.

The RS roller 316 is rotated in the same direction as or in the opposite direction to that of the developing sleeve 303 to thereby strips off, inside the developer container 309, any non-magnetic toner remaining on the developing sleeve 303 and feeds thereto a fresh non-magnetic toner. The developing sleeve 303 carries thereon the non-magnetic toner thus fed and is rotated in the direction of an arrow A to thereby transport the non-magnetic toner to a developing area D where the developing sleeve 303 and the photosensitive drum 106 face each other.

The non-magnetic toner carried on the developing sleeve 303 is pressed against the surface of the developing sleeve 303 by a developer layer thickness control member 315, so that its layer is formed in a uniform thickness. The non-magnetic toner is, as a result of the friction between it and the developing sleeve 303 and the friction between it and the developer layer thickness control member 315, provided with triboelectric charges sufficient for developing the electrostatic latent image formed on the photosensitive drum 306. The non-magnetic toner layer formed on the developing sleeve 303 may be in a thickness smaller than the minimum gap between the developing sleeve 303 and the photosensitive drum 106 in the developing area.

In order to cause the non-magnetic toner carried on the developing sleeve 303, to fly to the electrostatic latent image formed on the photosensitive drum to develop the latent image, a development bias voltage may be applied to the developing sleeve 303 through a development bias power source 308. As the development bias voltage, it may be either of a direct-current voltage and an alternating bias voltage, and its voltage may also be set at the same voltage as the above.

The RS roller 316 may preferably be an elastic roller made of rubber or the like. Where the elastic roller is used, it may be rotated in the direction of an arrow C, facing the developing sleeve 303. This is preferable in view of toner strip-off performance and toner feeding performance. The elastic roller may be set against the developing sleeve 303 at a penetration level of approximately from 0.5 mm or more to 2.5 mm or less.

It is preferable for the elastic blade 315 to be also one made of the same material, and having the same curved shape, as those of the elastic blade 215 of the magnetic one-component non-contact developing assembly shown in FIG. 1B, and to so set as to be pressed against the developing sleeve 303.

As the elastic blade 315, it is preferable to use, especially in order to secure a stable force for developer layer thickness control and to stably provide the non-magnetic toner with (negative) triboelectric charges, one having a structure wherein a polyamide elastomer (PAE) is stuck to the surface of a phosphor bronze plate, which can attain a stable pressure. The polyamide elastomer (PAE) may include copolymers of polyamide with polyether.

The elastic blade 315 may be brought into touch with the developing sleeve 303 at the same touch pressure as that in the case of the elastic blade 215 against the developer carrying member 205 in the magnetic one-component non-contact type shown in FIG. 1B.

The above example is a non-magnetic one-component non-contact type, which, however, may also preferably be used in a non-magnetic one-component contact developing assembly, in which the non-magnetic one-component developer layer on the developing sleeve 303 is formed in a thickness not less than the gap distance between the developing sleeve and the photosensitive drum in the developing area D.

Developer

The negatively chargeable developer (toner) used in the developing assembly described above is described below. The toner used in the developing assembly is one prepared by mixing a binder resin with a colorant, a charge control agent, a release agent, inorganic particles and so forth, and includes as its form the magnetic toner, which contains a magnetic material as an essential component, and the non-magnetic toner, which does not contain any magnetic material. The form is appropriately selected in conformity with the developing assembly.

The toner may have weight average particle diameter within the range of from 4 μm or more to 10 μm or less. This is preferable because the triboelectric charge quantity of the toner or the image quality and image density can be well balanced. As long as the toner has a weight average particle diameter of not more than 4 μm, any microdot images can be kept from being formed in a low reproducibility. On the other hand, as long as the toner has a weight average particle diameter of not less than 10 μm, any fog due to faulty triboelectric charging or any image density decrease can be kept from occurring.

As the binder resin of the toner, usable are, e.g., vinyl resin, polyester resin, polyurethane resin, epoxy resin and phenol resin. Of these, vinyl resin and polyester resin are preferred. For the purpose of improving triboelectric charge characteristics, a charge control agent may be used in the toner by incorporating the former in toner particles (internal addition) or blending it with toner particles (external addition). Such a charge control agent facilitates control of optimum charge quantity in accordance with developing systems.

EXAMPLES

The present invention is described below by giving working examples. In the following formulation, "part(s)" and "%" refer to "part(s) by mass" and "%" by mass", respectively, unless particularly noted. Methods for measuring physical properties according to the present invention are described first.

Developer Carrying Member (a) Acrylic Resin Analytical Method:

Chemical structure of the acrylic resin was determined by analyzing with a pyrolytic GC/MS analyzer (trade name: VOYAGER; manufactured by Thermo Electron Inc.) a sample obtained by cutting the resin layer of the developer carrying member.

Analytical conditions are shown below:

Pyrolytic temperature: 600° C.

Column: HP-1 (15 m×0.25 mm×0.25 μm).

Inlet: temperature 300° C.

Split: 20.0.

Injection rate: 1.2 ml/min.

Heating conditions: at temperature 50° C., retained for 4 minutes, and thereafter heated up to 300° C. at a heating rate of 20° C./min.

(b) Volume Resistance of Resin Layer:

A resin layer of 7 μm to 20 μm in thickness was formed on a PET sheet of 100 μm in thickness, and its volume resistivity was measured with a resistivity meter LORESTAR AP (manufactured by Mitsubishi Chemical Corporation), using a four-terminal probe. It was measured in an environment of a temperature of 20° C. to 25° C. and a humidity of 50% RH to 60% RH.

(c) Arithmetic-Mean Roughness Ra of Developer Carrying Member Surface:

The arithmetic-mean roughness Ra of the developer carrying member surface was measured according to JIS B 0601 (2001), using a surface roughness meter (trade name: SURFCORDER SE-3500; manufactured by Kosaka Laboratory, Ltd.). It was measured under conditions of a cut-off of 0.8 mm, a measurement distance of 4 mm and a feed rate of 0.5 mm/s. It was also measured at the positions of 3 spots in the axial direction×3 spots in the peripheral direction, i.e., 9 spots in total. Then, the average value of measured values at these measurement spots was taken as the arithmetic-mean roughness Ra of the developer carrying member surface.

(d) Volume Average Particle Diameter of Unevenness-Providing Particles:

A laser diffraction particle size distribution meter (trade name: COULTER LS-230 Particle Size Distribution Meter; manufactured by Beckman Coulter, Inc.) was used as an instrument for measuring the volume average particle diameter of the unevenness-providing particles. In the measurement, a small-level module was used and, as a measuring solvent, isopropyl alcohol (IPA) was used. First, the inside of a measuring system of the measuring instrument was washed with the IPA for about 5 minutes, and background function was executed after the washing. Next, about 10 mg of a measuring sample was added to 50 ml of IPA. The solution in which the sample was suspended was subjected to dispersion by means of an ultrasonic dispersion machine for about 2 minutes to obtain a sample fluid. Thereafter, the sample fluid was slowly added to the interior of the measuring system of the measuring instrument, and the sample concentration in the measuring system was so adjusted as to be 45% to 55% as PIDS (polarization intensity differential scattering) on the screen of the instrument. Thereafter, measurement was made, and volume average particle diameter calculated from volume distribution was determined.

(e) Layer Thickness of Resin Layer:

To measure the layer thickness of the resin layer, a controller (trade name: LS-5500; manufactured by Keyence Corporation) and a sensor head (trade name: LS-5040T; manufactured by Keyence Corporation) were used which were of a laser dimension measuring instrument which measures the outer diameter of a cylinder by using laser light.

First, the outer diameter size of the substrate was measured at 30 spots on the substrate in its axial direction. Next, the substrate was rotated by 90° in the peripheral direction, and thereafter the outer diameter of the substrate was likewise measured at 30 spots in the axial direction. That is, the outer diameter of the substrate was measured at 60 spots in total. The arithmetic-mean value of measured values thus found was taken as the outer diameter size of the substrate. Next, in the same way as the above, the outer diameter size of the developer carrying member was calculated. Then, a difference between the outer diameter size of the substrate and the outer diameter size of the developer carrying member was taken as the layer thickness of the resin layer.

Developer (f) Weight Average Particle Diameter D4 of Developer (Magnetic Toner):

Measured with a weight average particle diameter measuring instrument (trade name: COULTER MULTISIZER III; manufactured by Beckman Coulter, Inc.). As an electrolytic solution, an aqueous about 1% NaCl solution prepared using first-grade sodium chloride was used. About 0.5 ml of an alkylbenzenesulfonate as a dispersant was added to about 100 ml of the electrolytic solution, and further about 5 mg of a measuring sample was added. The electrolytic solution in which the sample was suspended was subjected to dispersion treatment for about 1 minute in an ultrasonic dispersion machine. The volume and number of the measuring sample were measure to calculate its volume distribution and number distribution, by means of the above measuring instrument and using a 100 μm aperture. From the results obtained, weight-base weight average particle diameter (D4) determined from volume distribution was determined.

(g) Average Circularity of Developer (Magnetic Toner);

The average circularity of the developer was measured with a flow type particle image analyzer (trade name: FPIA-3000, manufactured by Sysmex Corporation) and under conditions for the measurement and analysis at the time of correction operation. First, about 20 ml of ion-exchanged water, from which impurity solid matter and the like were beforehand removed, was put into a container made of glass. To this water, about 0.2 ml of a dilute solution was added as a dispersant, which was prepared by diluting with ion-exchanged water to about 3-fold by mass an aqueous 10% by mass solution of a pH 7 neutral detergent for washing precision measuring instruments which was composed of a nonionic surface-active agent, an anionic surface-active agent and an organic builder (CONTAMINON N, available from Wako Pure Chemical Industries, Ltd.). Further, about 0.02 g of a measuring sample was added, followed by dispersion treatment for 2 minutes by means of an ultrasonic dispersion machine to prepare a liquid dispersion for measurement. In that course, the dispersion system was appropriately so cooled that the liquid dispersion had a temperature of 10° C. or more to 40° C. or less.

As the ultrasonic dispersion machine, a desk-top ultrasonic washer dispersion machine (trade name: VS-150; manufactured by Velvo-Clear Co.) was used which was of 50 kHz in oscillation frequency and 150 W in electric output. Into its water tank, a stated amount of ion-exchanged water was put, and about 2 ml of the above CONTAMINON N was fed into this water tank. In the measurement, the flow type particle image analyzer was used, having an objective lens (trade name: UPlanApro; magnification: 10 times; number of aperture: 0.40), and a particle sheath (trade name: PSE-900A; available from Sysmex Corporation) was used as a sheath solution. The liquid dispersion having been controlled according to the above procedure was introduced into the flow type particle analyzer, where 3,000 toner particles were counted in an HPE measuring mode and in a total count mode. Then, the binary-coded threshold value at the time of particle analysis was set to 85%, and the diameter of particles to be analyzed were limited to circle-equivalent diameter of from 1.985 μm or more to less than 39.69 μm, where the average circularity of toner particles was determined.

In the measurement, before the measurement was started, autofocus control was performed using standard latex particles having been diluted with ion-exchanged water. As the standard latex particles, RESEARCH AND TEST PARTICLES Latex Microsphere Suspensions 5200A (trade name; available from Duke Scientific Corporation) was used.

In Examples, a flow type particle image analyzer was used on which correction was operated by Sysmex Corporation and for which a correction certificate issued by Sysmex Corporation was issued. Measurement was made under the measurement and analysis conditions set when the correction certificate was received, except that the diameters of particles to be analyzed were limited to the circle-equivalent diameter of from 1.985 μm or more to less than 39.69 μm.

(1) Production of Developer (Magnetic Toner)

Production Example D-1 (Developer D-1)

Production of Hybrid Resin

TABLE 1

| | |
|---|---|
| Polyoxypropylene (2.2)-2,2-bis(4-hydroxyphenyl) propane | 7.0 mol |
| Polyoxyethylene (2.0)-2,2-bis(4-hydroxyphenyl) propane | 3.0 mol |
| Terephthalic acid | 3.0 mol |
| Trimellitic anhydride | 1.9 mol |
| Fumaric acid | 5.0 mol |
| Butyltin oxide | 0.2 g |

The materials set out in the above Table 1 were put into a 4-liter four-necked flask made of glass, and a thermometer, a stirring rod, a condenser and a nitrogen feed tube were attached thereto. This flask was placed in a mantle heater.

TABLE 2

| | |
|---|---|
| Styrene | 1.9 mol |
| 2-Ethylhexyl acrylate | 0.21 mol |
| Fumaric acid | 0.15 mol |
| α-Methylstyrene dimer | 0.03 mol |
| Dicumyl peroxide | 0.05 mol |

The materials set out in the above Table 2 were put into a dropping funnel as vinyl polymer materials. Next, the inside atmosphere of the flask was displaced with nitrogen gas, followed by gradual heating with stirring. With stirring at a temperature of 145° C., the vinyl polymer materials were dropwise added over a period of 4 hours from the above dropping funnel. Then, these were heated to a temperature of 200° C. to carry out reaction for 4 hours to obtain a hybrid resin.

TABLE 3

| | parts by mass |
|---|---|
| Above hybrid resin | 100 |
| Magnetic iron oxide (primary average particle diameter: 0.18 μm) | 75 |
| Monoazo iron complex (trade name: T-77, available from Hodogaya Chemical Co., Ltd.) | 2 |
| Low-molecular weight ethylene-propylene copolymer (trade name: VISKOL 550-P; available from Sanyo Chemical Industries, Ltd.) | 5 |

A mixture of the materials set out in the above Table 3 was melt-kneaded by means of a twin-screw extruder heated to 130° C., and thereafter the mixture obtained by melt kneading was cooled to solidify. The mixture thus cooled to solidify was crushed by using a hammer mill. The crushed product obtained was finely pulverized by means of Turbo mill (trade name: T250; manufactured by Turbo Kogyo Co., Ltd.), and then the finely pulverized product obtained was classified by means of an air classifier to obtain magnetic toner particles having a weight average particle diameter of 5.5 μm.

To 100 parts of the magnetic toner particles obtained, 1.0 part of hydrophobic fine silica particles (BET specific surface area: 180 $m^2/g$) were externally added by means of Henschel mixer (trade name: Model FM-75, manufactured by Mitsui Miike Engineering Corporation) to obtain Developer D-1 (Magnetic Toner D-1) having a circularity of 0.935.

(2) Production of Developer Carrying Member

Acrylic Resin

Production Example A-1

Acrylic Resin Solution A-1

In a four-necked separable flask fitted with a stirrer, a condenser, a thermometer, a nitrogen feed tube and a dropping funnel, materials shown in Table 4 below were mixed, and stirred until the system became uniform.

TABLE 4

| | |
|---|---|
| Dimethyllaurylamine | 27.3 parts by mass |
| p-Toluenesulfonic acid | 22.0 parts by mass |
| Ethanol | 60 parts by mass |

While continuing to stir the materials shown in the above Table 4, the materials were heated to a temperature of 80° C., followed by stirring for 2 hours to obtain a quaternary ammonium salt-containing solution. The quaternary ammonium salt-containing solution obtained was cooled, and thereafter 18.2 parts by mass of glycidyl methacrylate was added thereto. The mixture obtained was heated to a temperature of 80° C. and thereafter stirred for 2 hours to obtain a quaternary ammonium base-containing monomer.

The reaction solution thus obtained was cooled, and thereafter 32.5 parts by mass of lauryl methacrylate as a copolymerization component, 50 parts by mass of ethanol as a solvent and 1.0 part by mass of azobisisobutyronitrile (AIBN) as a polymerization initiator were fed thereinto, followed by stirring until the system became uniform. While continuing to stir the reaction system, the system was heated until its internal temperature came to be 70° C., and a portion fed into the dropping funnel was added thereto over a period of 1 hour. After this dropwise addition was completed, the reaction was further carried out for 5 hours in the state of reflux under introduction of nitrogen, and 0.2 part by mass of AIBN was further added thereto. Thereafter, the reaction was carried out for 1 hour. Further, the solution thus obtained was diluted with ethanol to obtain an acrylic resin solution A-1 having a solid content of 40%. The acrylic resin solution obtained was analyzed by the acrylic resin analytical method described in the above (a). As the result, the acrylic resin was found to be a copolymer of a unit of Formula (8) and a unit of Formula (9).

(8)

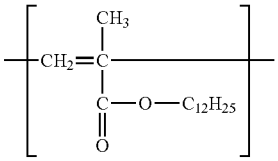

(9)

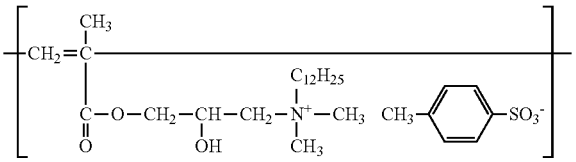

Production Examples A-2 to A-11

Acrylic Resin Solutions A-2 to A-11

Acrylic resin solutions A-2 to A-11 were obtained in the same way as the acrylic resin solution A-1 except that monomers shown in Table 6 below were used. Structures of the acrylic resins obtained are shown in Table 7 below.

Production Example A-12

Acrylic Resin Solution A-12

In a four-necked separable flask fitted with a stirrer, a condenser, a thermometer, a nitrogen feed tube and a dropping funnel, materials shown in Table 5 below were mixed, and stirred until the mixture became uniform. While continuing to stir the mixture, this was heated to a temperature of 80° C., followed by stirring for 2 hours to obtain a quaternary ammonium salt-containing aqueous solution.

TABLE 5

| | |
|---|---|
| Dimethyllaurylamine | 30.9 parts by mass |
| Hydrogen bromide (as effective component in 48% hydrobromic acid solution) | 11.7 parts by mass |

The quaternary ammonium salt-containing aqueous solution obtained was dried, and thereafter 20.6 parts by mass of glycidyl methacrylate and 60 parts by mass of ethanol were added thereto. The mixture obtained was heated to a temperature of 80° C. and thereafter stirred for 2 hours to obtain a monomer having a quaternary ammonium base.

The reaction solution thus obtained was cooled, and thereafter 36.8 parts by mass of lauryl methacrylate as a copolymerization component, 50 parts by mass of ethanol as a solvent and 1.0 part by mass of azobisisobutyronitrile (AIBN)

as a polymerization initiator were fed thereinto, followed by stirring until the mixture became uniform. While continuing to stir the reaction system, the system was heated until its internal temperature came to be 70° C., and a portion fed into the dropping funnel was added thereto over a period of 1 hour. After this dropwise addition was completed, the reaction was further carried out for 5 hours in the state of reflux under introduction of nitrogen, and 0.2 part by mass of AIBN was further added thereto. Thereafter, the reaction was carried out for 1 hour. Further, the solution thus obtained was diluted with ethanol to obtain an acrylic resin solution A-12 having a solid content of 40%.

Production Examples A-13 to A-45

Acrylic Resin Solutions A-13 to A-45

Acrylic resin solutions A-13 to A-45 were obtained in the same way as the acrylic resin solution A-1 or acrylic resin solution A-12 except that materials shown in Tables 6-1 and 6-2 were used. A-14 to A-20, A-22 to A-28, A-30 to A-32, A-34 to A-42, A-44 and A-45 were done in the same way as the acrylic resin solution A-1, and A-13, A-21, A-29, A-33 and A-43 were done in the same way as the acrylic resin solution A-12. Structures of the acrylic resins obtained are shown in Table Tables 7-1 and 7-2.

TABLE 6-1

| Acrylic | Unit-(2) forming raw-materials | | | | | | Unit-(1) forming raw-materials | | | |
|---|---|---|---|---|---|---|---|---|---|---|
| resin | Monomer | | Organic amine | | Acid component | | Monomer(1) | | Monomer(2) | |
| solution | Type | pbm | Type | pbm | Type | pbm | Type | pbm | Type | pbm |
| A-1 | GMA | 18.2 | Dimethyllaurylamine | 27.3 | p-Toluenesulfonic acid | 22.0 | RMA | 32.5 | — | — |
| A-2 | GMA | 18.5 | Dimethyllaurylamine | 27.8 | p-Toluenesulfonic acid | 22.4 | RA | 31.3 | — | — |
| A-3 | GMA | 19.6 | Dimethyllaurylamine | 29.4 | p-Toluenesulfonic acid | 23.7 | OMA | 27.3 | — | — |
| A-4 | GMA | 17.3 | Dimethyllaurylamine | 25.9 | p-Toluenesulfonic acid | 20.9 | ODMA | 16.4 | TDMA | 19.5 |
| A-5 | GA | 16.7 | Dimethyllaurylamine | 27.8 | p-Toluenesulfonic acid | 22.4 | RMA | 33.1 | — | — |
| A-6 | GMA | 21.2 | Dimethylbutylamine | 15.1 | p-Toluenesulfonic acid | 25.7 | RMA | 38.0 | — | — |
| A-7 | GMA | 19.6 | Dimethyloctylamine | 21.7 | p-Toluenesulfonic acid | 23.7 | RMA | 35.0 | — | — |
| A-8 | GMA | 15.4 | Trioctylamine | 38.3 | p-Toluenesulfonic acid | 18.7 | RMA | 27.6 | — | — |
| A-9 | GMA | 16.4 | Dimethylstearylamine | 34.3 | p-Toluenesulfonic acid | 19.9 | RMA | 29.4 | — | — |
| A-10 | GMA | 15.2 | Dilaurylmonomethylamine | 39.3 | p-Toluenesulfonic acid | 18.4 | RMA | 27.2 | — | — |
| A-11 | GMA | 19.9 | Dimethylamine hexanol | 20.3 | p-Toluenesulfonic acid | 24.1 | RMA | 35.6 | — | — |
| A-12 | GMA | 20.6 | Dimethyllaurylamine | 30.9 | Hydrogen bromide | 11.7 | RMA | 36.8 | — | — |
| A-13 | GMA | 22.0 | Dimethyllaurylamine | 33.0 | Hydrogen chloride | 5.7 | RMA | 39.3 | — | — |
| A-14 | GMA | 20.2 | Dimethyllaurylamine | 30.3 | Methylsulfonic acid | 13.5 | RMA | 36.1 | — | — |
| A-15 | GMA | 5.0 | Dimethyllaurylamine | 7.6 | p-Toluenesulfonic acid | 6.1 | RMA | 81.3 | — | — |
| A-16 | GMA | 9.2 | Dimethyllaurylamine | 13.8 | p-Toluenesulfonic acid | 11.1 | RMA | 65.8 | — | — |
| A-17 | GMA | 24.0 | Dimethyllaurylamine | 36.1 | p-Toluenesulfonic acid | 29.1 | RMA | 10.8 | — | — |
| A-18 | GMA | 25.6 | Dimethyllaurylamine | 38.4 | p-Toluenesulfonic acid | 31.0 | RMA | 5.1 | — | — |
| A-19 | GA | 21.4 | Dimethylbutylamine | 16.9 | p-Toluenesulfonic acid | 28.7 | OMA | 33.1 | — | — |
| A-20 | GMA | 16.2 | Dilaurylmonomethylamine | 41.8 | p-Toluenesulfonic acid | 19.6 | OMA | 22.5 | — | — |
| A-21 | GMA | 22.4 | Dimethyllaurylamine | 33.6 | Hydrogen bromide | 12.8 | OMA | 31.2 | — | — |
| A-22 | GMA | 30.1 | Dimethyllaurylamine | 45.1 | Methylsulfonic acid | 20.1 | OMA | 4.7 | — | — |
| A-23 | GMA | 20.0 | Dimethylbutylamine | 14.2 | p-Toluenesulfonic acid | 24.2 | ODMA | 19.0 | TDMA | 22.6 |
| A-24 | GMA | 14.7 | Trioctylamine | 36.7 | p-Toluenesulfonic acid | 17.9 | ODMA | 14.0 | TDMA | 16.7 |
| A-25 | GMA | 8.3 | Dimethylstearylamine | 17.3 | Methylsulfonic acid | 5.5 | ODMA | 31.5 | TDMA | 37.4 |
| A-26 | GMA | 23.6 | Dimethyllaurylamine | 35.4 | p-Toluenesulfonic acid | 28.6 | ODMA | 5.6 | TDMA | 6.7 |
| A-27 | GMA | 8.4 | Trioctylamine | 21.0 | p-Toluenesulfonic acid | 10.2 | RMA | 60.4 | — | — |
| A-28 | GMA | 18.0 | Dimethylstearylamine | 37.7 | Methylsulfonic acid | 12.1 | RMA | 32.2 | — | — |
| A-29 | GMA | 16.8 | Dilaurylmonomethylamine | 43.5 | Hydrogen bromide | 9.6 | RMA | 30.1 | — | — |
| A-30 | GMA | 29.7 | Dimethylbutylamine | 21.1 | p-Toluenesulfonic acid | 35.9 | RMA | 13.3 | — | — |

TABLE 6-2

| Acrylic | Unit-(2) forming raw-materials | | | | | | Unit-(1) forming raw-materials | | | |
|---|---|---|---|---|---|---|---|---|---|---|
| resin | Monomer | | Organic amine | | Acid component | | Monomer(1) | | Monomer(2) | |
| solution | Type | pbm | Type | pbm | Type | pbm | Type | pbm | Type | pbm |
| A-31 | GMA | 24.6 | Dimethylbutylamine | 17.5 | Methylsulfonic acid | 16.4 | RA | 41.5 | — | — |
| A-32 | GMA | 9.7 | Dimethyllaurylamine | 14.5 | Methylsulfonic acid | 6.5 | RMA | 69.3 | — | — |
| A-33 | GA | 29.0 | Dimethyllaurylamine | 48.3 | Hydrogen chloride | 8.3 | RMA | 14.4 | — | — |
| A-34 | GMA | 22.6 | Dimethyllaurylamine | 34.0 | p-Toluenesulfonic acid | 27.4 | MMA | 15.9 | — | — |
| A-35 | GMA | 21.2 | Dimethyllaurylamine | 31.8 | p-Toluenesulfonic acid | 25.7 | BMA | 21.2 | — | — |
| A-36 | GMA | 16.8 | Dimethyllaurylamine | 25.2 | p-Toluenesulfonic acid | 20.3 | DCMA | 18.6 | TDMA | 19.0 |
| A-37 | GMA | 22.6 | Trimethylamine | 9.4 | p-Toluenesulfonic acid | 27.4 | RMA | 40.5 | — | — |
| A-38 | GMA | 21.2 | Triethylamine | 15.1 | p-Toluenesulfonic acid | 25.7 | RMA | 38.0 | — | — |
| A-39 | GMA | 15.4 | Dimethylbehenylamine | 38.3 | p-Toluenesulfonic acid | 18.7 | RMA | 27.6 | — | — |
| A-40 | GMA | 21.6 | Dimethylethanolamine | 13.5 | p-Toluenesulfonic acid | 26.2 | RMA | 38.7 | — | — |
| A-41 | GMA | 35.9 | Trimethylamine | 14.9 | Methylsulfonic acid | 24.0 | MMA | 25.3 | — | — |

TABLE 6-2-continued

| Acrylic resin solution | Unit-(2) forming raw-materials: Monomer Type | Monomer pbm | Organic amine Type | Organic amine pbm | Acid component Type | Acid component pbm | Unit-(1) forming raw-materials: Monomer(1) Type | Monomer(1) pbm | Monomer(2) Type | Monomer(2) pbm |
|---|---|---|---|---|---|---|---|---|---|---|
| A-42 | GMA | 4.2 | Dimethyllaurylamine | 6.3 | p-Toluenesulfonic acid | 5.1 | DCMA | 41.8 | TDMA | 42.7 |
| A-43 | GMA | 24.6 | Triethylamine | 17.5 | Hydrogen bromide | 14.0 | RMA | 43.9 | — | — |
| A-44 | GMA | 20.5 | Dimethylbehenylamine | 50.9 | p-Toluenesulfonic acid | 24.8 | RA | 3.8 | — | — |
| A-45 | GA | 4.9 | Dimethylethanolamine | 3.4 | Methylsulfonic acid | 3.7 | RMA | 88.0 | — | — |

In Tables 6-1 and 6-2, letter symbols set out in the column of monomer type stand for the following compounds.

GMA: glycidyl methacrylate; GA: glycidyl acrylate; MMA: methyl methacrylate; BMA: butyl methacrylate; OMA: octyl methacrylate; RA: lauryl acrylate; RMA: lauryl methacrylate; TDMA: tridecyl methacrylate; ODMA: octadecyl methacrylate; DCMA: dococyl methacrylate

TABLE 7-1

| Acrylic resin solution | Unit (2): $R_3$ | $R_4$ | $R_5$ | $R_6$ | $R_7$ | Anionic species | Unit ratio | Unit (1) Part 1: $R_1$ | $R_2$ | Unit ratio | Part 2: $R_1$ | $R_2$ | Unit ratio | B/(A + B) |
|---|---|---|---|---|---|---|---|---|---|---|---|---|---|---|
| A-1 | $CH_3$ | $CH_3$ | $CH_3$ | $CH_3$ | $C_{12}H_{25}$ | p-Toluenesulfonic acid | 0.5 | $CH_3$ | $C_{12}H_{25}$ | 0.5 | | — | — | 0.5 |
| A-2 | $CH_3$ | $CH_3$ | $CH_3$ | $CH_3$ | $C_{12}H_{25}$ | p-Toluenesulfonic acid | 0.5 | H | $C_{12}H_{25}$ | 0.5 | | — | — | 0.5 |
| A-3 | $CH_3$ | $CH_3$ | $CH_3$ | $CH_3$ | $C_{12}H_{25}$ | p-Toluenesulfonic acid | 0.5 | $CH_3$ | $C_8H_{17}$ | 0.5 | | — | — | 0.5 |
| A-4 | $CH_3$ | $CH_3$ | $CH_3$ | $CH_3$ | $C_{12}H_{25}$ | p-Toluenesulfonic acid | 0.5 | $CH_3$ | $C_{18}H_{37}$ | 0.2 | $CH_3$ | $C_{13}H_{27}$ | 0.3 | 0.5 |
| A-5 | H | $CH_3$ | $CH_3$ | $CH_3$ | $C_{12}H_{25}$ | p-Toluenesulfonic acid | 0.5 | $CH_3$ | $C_{12}H_{25}$ | 0.5 | | — | — | 0.5 |
| A-6 | $CH_3$ | $CH_3$ | $CH_3$ | $CH_3$ | $C_4H_9$ | p-Toluenesulfonic acid | 0.5 | $CH_3$ | $C_{12}H_{25}$ | 0.5 | | — | — | 0.5 |
| A-7 | $CH_3$ | $CH_3$ | $CH_3$ | $CH_3$ | $C_8H_{17}$ | p-Toluenesulfonic acid | 0.5 | $CH_3$ | $C_{12}H_{25}$ | 0.5 | | — | — | 0.5 |
| A-8 | $CH_3$ | $CH_3$ | $C_8H_{17}$ | $C_8H_{17}$ | $C_8H_{17}$ | p-Toluenesulfonic acid | 0.5 | $CH_3$ | $C_{12}H_{25}$ | 0.5 | | — | — | 0.5 |
| A-9 | $CH_3$ | $CH_3$ | $CH_3$ | $CH_3$ | $C_{18}H_{37}$ | p-Toluenesulfonic acid | 0.5 | $CH_3$ | $C_{12}H_{25}$ | 0.5 | | — | — | 0.5 |
| A-10 | $CH_3$ | $CH_3$ | $CH_3$ | $C_{12}H_{25}$ | $C_{12}H_{25}$ | p-Toluenesulfonic acid | 0.5 | $CH_3$ | $C_{12}H_{25}$ | 0.5 | | — | — | 0.5 |
| A-11 | $CH_3$ | $CH_3$ | $CH_3$ | $CH_3$ | $C_6H_{12}OH$ | p-Toluenesulfonic acid | 0.5 | $CH_3$ | $C_{12}H_{25}$ | 0.5 | | — | — | 0.5 |
| A-12 | $CH_3$ | $CH_3$ | $CH_3$ | $CH_3$ | $C_{12}H_{25}$ | Br | 0.5 | $CH_3$ | $C_{12}H_{25}$ | 0.5 | | — | — | 0.5 |
| A-13 | $CH_3$ | $CH_3$ | $CH_3$ | $CH_3$ | $C_{12}H_{25}$ | Cl | 0.5 | $CH_3$ | $C_{12}H_{25}$ | 0.5 | | — | — | 0.5 |
| A-14 | $CH_3$ | $CH_3$ | $CH_3$ | $CH_3$ | $C_{12}H_{25}$ | Methylsulfonic acid | 0.5 | $CH_3$ | $C_{12}H_{25}$ | 0.5 | | — | — | 0.5 |
| A-15 | $CH_3$ | $CH_3$ | $CH_3$ | $CH_3$ | $C_{12}H_{25}$ | p-Toluenesulfonic acid | 0.1 | $CH_3$ | $C_{12}H_{25}$ | 0.9 | | — | — | 0.1 |
| A-16 | $CH_3$ | $CH_3$ | $CH_3$ | $CH_3$ | $C_{12}H_{25}$ | p-Toluenesulfonic acid | 0.2 | $CH_3$ | $C_{12}H_{25}$ | 0.8 | | — | — | 0.2 |
| A-17 | $CH_3$ | $CH_3$ | $CH_3$ | $CH_3$ | $C_{12}H_{25}$ | p-Toluenesulfonic acid | 0.8 | $CH_3$ | $C_{12}H_{25}$ | 0.2 | | — | — | 0.8 |
| A-18 | $CH_3$ | $CH_3$ | $CH_3$ | $CH_3$ | $C_{12}H_{25}$ | p-Toluenesulfonic acid | 0.9 | $CH_3$ | $C_{12}H_{25}$ | 0.1 | | — | — | 0.9 |
| A-19 | H | $CH_3$ | $CH_3$ | $CH_3$ | $C_4H_9$ | p-Toluenesulfonic acid | 0.5 | $CH_3$ | $C_8H_{17}$ | 0.5 | | — | — | 0.5 |
| A-20 | $CH_3$ | $CH_3$ | $CH_3$ | $C_{12}H_{25}$ | $C_{12}H_{25}$ | p-Toluenesulfonic acid | 0.5 | $CH_3$ | $C_8H_{17}$ | 0.5 | | — | — | 0.5 |

TABLE 7-2

| Acrylic resin solution | Unit (2): $R_3$ | $R_4$ | $R_5$ | $R_6$ | $R_7$ | Anionic species | Unit ratio | Unit (1) Part 1: $R_1$ | $R_2$ | Unit ratio | Part 2: $R_1$ | $R_2$ | Unit ratio | B/(A + B) |
|---|---|---|---|---|---|---|---|---|---|---|---|---|---|---|
| A-21 | $CH_3$ | $CH_3$ | $CH_3$ | $CH_3$ | $C_{12}H_{25}$ | Br | 0.5 | $CH_3$ | $C_8H_{17}$ | 0.5 | | — | — | 0.5 |
| A-22 | $CH_3$ | $CH_3$ | $CH_3$ | $CH_3$ | $C_{12}H_{25}$ | Methylsulfonic acid | 0.9 | $CH_3$ | $C_8H_{17}$ | 0.1 | | — | — | 0.9 |
| A-23 | $CH_3$ | $CH_3$ | $CH_3$ | $CH_3$ | $C_4H_9$ | p-Toluenesulfonic acid | 0.5 | $CH_3$ | $C_{18}H_{37}$ | 0.2 | $CH_3$ | $C_{13}H_{27}$ | 0.3 | 0.5 |
| A-24 | $CH_3$ | $CH_3$ | $C_8H_{17}$ | $C_8H_{17}$ | $C_8H_{17}$ | p-Toluenesulfonic acid | 0.5 | $CH_3$ | $C_{18}H_{37}$ | 0.2 | $CH_3$ | $C_{13}H_{27}$ | 0.3 | 0.5 |
| A-25 | $CH_3$ | $CH_3$ | $CH_3$ | $CH_3$ | $C_{18}H_{37}$ | Methylsulfonic acid | 0.2 | $CH_3$ | $C_{18}H_{37}$ | 0.32 | $CH_3$ | $C_{13}H_{27}$ | 0.48 | 0.2 |
| A-26 | $CH_3$ | $CH_3$ | $CH_3$ | $CH_3$ | $C_{12}H_{25}$ | p-Toluenesulfonic acid | 0.8 | $CH_3$ | $C_{18}H_{37}$ | 0.08 | $CH_3$ | $C_{13}H_{27}$ | 0.12 | 0.8 |
| A-27 | $CH_3$ | $CH_3$ | $C_8H_{17}$ | $C_8H_{17}$ | $C_8H_{17}$ | p-Toluenesulfonic acid | 0.2 | $CH_3$ | $C_{12}H_{25}$ | 0.8 | | — | — | 0.2 |
| A-28 | $CH_3$ | $CH_3$ | $CH_3$ | $CH_3$ | $C_{18}H_{37}$ | Methylsulfonic acid | 0.5 | $CH_3$ | $C_{12}H_{25}$ | 0.5 | | — | — | 0.5 |
| A-29 | $CH_3$ | $CH_3$ | $CH_3$ | $C_{12}H_{25}$ | $C_{12}H_{25}$ | Br | 0.5 | $CH_3$ | $C_{12}H_{25}$ | 0.5 | | — | — | 0.5 |
| A-30 | $CH_3$ | $CH_3$ | $CH_3$ | $CH_3$ | $C_4H_9$ | p-Toluenesulfonic acid | 0.8 | $CH_3$ | $C_{12}H_{25}$ | 0.2 | | — | — | 0.8 |
| A-31 | $CH_3$ | $CH_3$ | $CH_3$ | $CH_3$ | $C_4H_9$ | Methylsulfonic acid | 0.5 | H | $C_{12}H_{25}$ | 0.5 | | — | — | 0.5 |
| A-32 | $CH_3$ | $CH_3$ | $CH_3$ | $CH_3$ | $C_{12}H_{25}$ | Methylsulfonic acid | 0.2 | $CH_3$ | $C_{12}H_{25}$ | 0.8 | | — | — | 0.2 |
| A-33 | H | $CH_3$ | $CH_3$ | $CH_3$ | $C_{12}H_{25}$ | Cl | 0.8 | $CH_3$ | $C_{12}H_{25}$ | 0.2 | | — | — | 0.8 |
| A-34 | $CH_3$ | $CH_3$ | $CH_3$ | $CH_3$ | $C_{12}H_{25}$ | p-Toluenesulfonic acid | 0.5 | $CH_3$ | $CH_3$ | 0.5 | | — | — | 0.5 |
| A-35 | $CH_3$ | $CH_3$ | $CH_3$ | $CH_3$ | $C_{12}H_{25}$ | p-Toluenesulfonic acid | 0.5 | $CH_3$ | $C_4H_9$ | 0.5 | | — | — | 0.5 |
| A-36 | $CH_3$ | $CH_3$ | $CH_3$ | $CH_3$ | $C_{12}H_{25}$ | p-Toluenesulfonic acid | 0.5 | $CH_3$ | $C_{22}H_{45}$ | 0.2 | $CH_3$ | $C_{13}H_{27}$ | 0.3 | 0.5 |
| A-37 | $CH_3$ | $CH_3$ | $CH_3$ | $CH_3$ | $CH_3$ | p-Toluenesulfonic acid | 0.5 | $CH_3$ | $C_{12}H_{25}$ | 0.5 | | — | — | 0.5 |
| A-38 | $CH_3$ | $CH_3$ | $C_2H_5$ | $C_2H_5$ | $C_2H_5$ | p-Toluenesulfonic acid | 0.5 | $CH_3$ | $C_{12}H_{25}$ | 0.5 | | — | — | 0.5 |
| A-39 | $CH_3$ | $CH_3$ | $CH_3$ | $CH_3$ | $C_{22}H_{45}$ | p-Toluenesulfonic acid | 0.5 | $CH_3$ | $C_{12}H_{25}$ | 0.5 | | — | — | 0.5 |
| A-40 | $CH_3$ | $CH_3$ | $CH_3$ | $CH_3$ | $C_2H_4OH$ | p-Toluenesulfonic acid | 0.5 | $CH_3$ | $C_{12}H_{25}$ | 0.5 | | — | — | 0.5 |
| A-41 | $CH_3$ | $CH_3$ | $CH_3$ | $CH_3$ | $CH_3$ | Methylsulfonic acid | 0.5 | $CH_3$ | $CH_3$ | 0.5 | | — | — | 0.5 |
| A-42 | $CH_3$ | $CH_3$ | $CH_3$ | $CH_3$ | $C_{12}H_{25}$ | p-Toluenesulfonic acid | 0.1 | $CH_3$ | $C_{22}H_{45}$ | 0.36 | $CH_3$ | $C_{13}H_{27}$ | 0.54 | 0.1 |
| A-43 | $CH_3$ | $CH_3$ | $C_2H_5$ | $C_2H_5$ | $C_2H_5$ | Br | 0.5 | $CH_3$ | $C_{12}H_{25}$ | 0.5 | | — | — | 0.5 |

TABLE 7-2-continued

| Acrylic resin solution | Unit (2) $R_3$ | $R_4$ | $R_5$ | $R_6$ | $R_7$ | Anionic species | Unit ratio | Unit (1) Part 1 $R_1$ | $R_2$ | Unit ratio | Part 2 $R_1$ | $R_2$ | Unit ratio | B/(A + B) |
|---|---|---|---|---|---|---|---|---|---|---|---|---|---|---|
| A-44 | $CH_3$ | $CH_3$ | $CH_3$ | $CH_3$ | $C_{22}H_{45}$ | p-Toluenesulfonic acid | 0.9 | H | $C_{12}H_{25}$ | 0.1 | — | — | — | 0.9 |
| A-45 | H | $CH_3$ | $CH_3$ | $CH_3$ | $C_2H_4OH$ | Methylsulfonic acid | 0.1 | $CH_3$ | $C_{12}H_{25}$ | 0.9 | — | — | — | 0.1 |

Thermosetting Resin

As the thermosetting resin used in the developer carrying member, any of those set out in Table 8 below was used.

TABLE 8

| | |
|---|---|
| Thermosetting resin B-1 | Thermosetting resol type phenol resin solution containing 40 wt. % methanol (trade name: J-325; available from Dainippon Ink & Chemicals, Incorporated) |
| Thermosetting resin B-2 | Thermosetting butylated melamine resin (trade name: L-109-65; available from Dainippon Ink & Chemicals, Incorporated) |
| Thermosetting resin B-3 | 8:2 (mass ratio)-Blend of epoxy resin (trade name: 1001B80; available from Japan Epoxy Resins Co., Ltd.) and curing agent (trade name: SL11; available from Japan Epoxy Resins Co., Ltd.) |
| Thermosetting resin B-4 (for Comparative Example) | Thermoplastic acrylic resin (trade name: A-430-60; available from Dainippon Ink & Chemicals, Incorporated) |

Electroconductive Particles

As the electroconductive particles used in the developer carrying member, those set out in Table 9 below were used.

TABLE 9

| | |
|---|---|
| Electroconductive particles C-1 | Trade name: TOKA BLACK #5500: available from Tokai Carbon Co., Ltd. |
| Electroconductive particles C-2 | Trade name: CSP-E (primary average particle diameter: 4.5 μm); available from Nippon Graphite Industries, Ltd. |

Unevenness-Providing Particles

As the unevenness-providing particles, a powder of artificial graphite set out in Table 10 below was used.

TABLE 10

| | |
|---|---|
| Unevenness-providing particles | Trade name: NICABEADS ICB-0520; available from Nippon Carbon Co., Ltd. (volume average particle diameter: 6.2 μm) |

Example 1

Developer Carrying Member E-1

A developer carrying member E-1 was produced in the following way. First, materials shown in Table 11 below were mixed, and the mixture obtained was treated by means of a horizontal sand mill (using zirconia beads of 1.0 mm in diameter in a packing of 85%) to obtain a coating fluid.

TABLE 11

| | |
|---|---|
| Acrylic resin solution A-1 | Solid content: 10 parts by mass (25 parts by mass as solution) |
| Resin B-1 | Solid content: 100 parts by mass (166.7 parts by mass as solution) |
| Electroconductive particles C-1 | 4 parts by mass |
| Electroconductive particles C-2 | 36 parts by mass |
| Unevenness-providing particles | 10 parts by mass |
| Methanol | 120 parts by mass |

A cylindrical pipe made of aluminum and having an outer diameter of 20 mm (Ra: 0.4 μm; reference length (lr): 4 mm) was readied as a substrate. This substrate was masked at its both end portions by 6 mm each, and thereafter so placed that its axis was parallel to the vertical. Then, this substrate was rotated at 1,000 rpm, and was coated with the coating fluid while a spray gun was descended at 30 mm/second, to form a coating in such a way that it came to be 12 μm in thickness as a result of hardening. Subsequently, the coating was hardened by heating it for 30 minutes in a temperature 150° C. hot-air drying oven, to produce a developer carrying member, E-1. A magnet roller was inserted to the developer carrying member E-1 obtained, and flanges were fitted to its both ends. This developer carrying member was fitted, as a developing roller, to a developing assembly of an electrophotographic image forming apparatus (trade name: iR3245; manufactured by CANON INC.). The gap between its magnetic doctor blade and the developer carrying member E-1 was set to 210 μm.

As a developer, the developer D-1 was loaded into this electrophotographic image forming apparatus, and images were reproduced. The images obtained were evaluated on their image density, image quality and density non-uniformity according to the following criteria. The images were reproduced in a normal-temperature and low-humidity environment (temperature 23° C., humidity 5% RH; N/L), a normal-temperature and normal-humidity environment (temperature 23° C., humidity 50% RH; N/N) and a high-temperature and high-humidity environment (temperature 30° C., humidity 80% RH; H/H). As the images, character images with a print percentage of 3% were continuously reproduced on up to 500,000 sheets in lateral feed of A4-size plain paper (trade name: OFFICE PLANNER; available from CANON SALES CO. INC.; 68 g/m$^2$), and evaluation was made on each of image density, image quality and density non-uniformity at the initial stage and after the 500,000-sheet image reproduction. On blotches, evaluation was made at the initial stage. Results obtained are shown in Table 4.

(A) Image Density:

Using a reflection densitometer (trade name: RD918; manufactured by Macbeth Co.), the density of solid black areas when solid black images were printed was measured at 5 spots, and an average value thereof was taken as the image density. Also, a difference in image density between the images at the initial stage and those after the 500,000-sheet image reproduction was calculated to find density difference.

Figure 3:
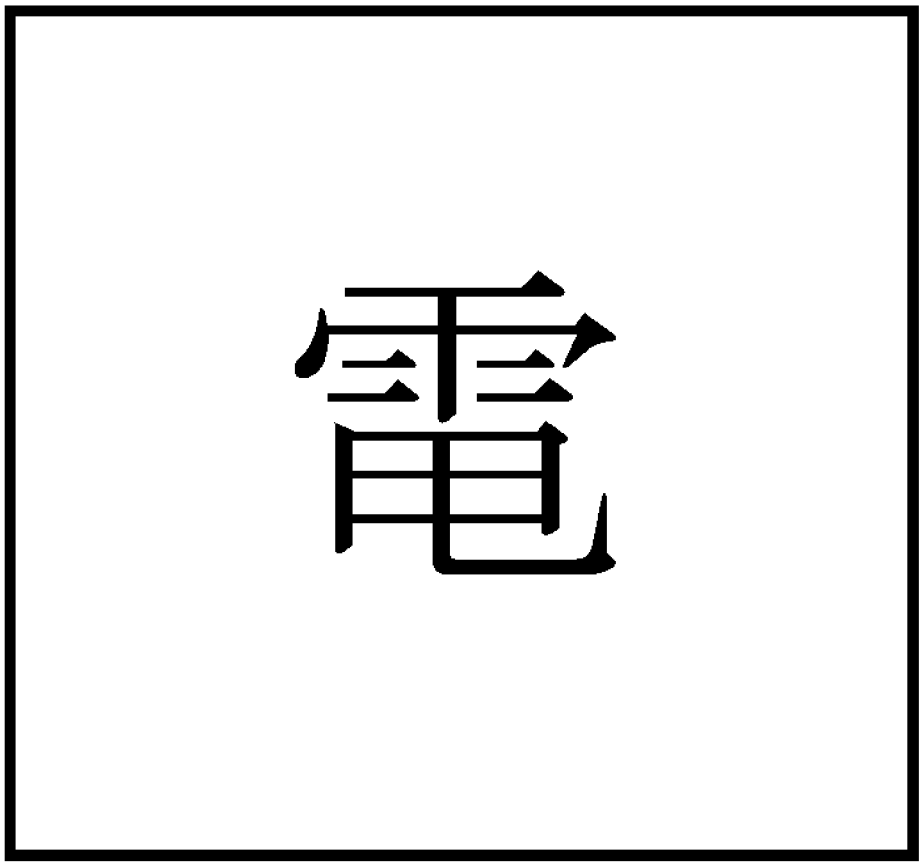
FIG. 3 is a Chinese character used in evaluating images in Examples.

(B) Image Quality Evaluation:

A Chinese character image shown in FIG. 3, having a font size of 4 points, was reproduced, and any blurred images of the Chinese character and/or spots of toner around images were observed with the naked eye and with use of a magnifier (magnification: 10 times) to evaluate image quality according to the following criteria.

A: Neither blurred images of the Chinese character nor spots of toner around images of the Chinese character are seen even in observation with the magnifier.

B: Sharp images are seen in observation with the naked eye.

C: Spots of toner around images are somewhat seen on the Chinese character in observation with the naked eye.

D: Blurred images of the Chinese character are seen even in observation with the naked eye. Spots of toner around images are also seen on the Chinese character.

(C) Density Non-Uniformity:

Halftone images and solid black images were reproduced, and line-shaped or belt-shaped tone differences that ran in the direction of the progress of image formation were observed with the naked eye to make evaluation according to the following criteria. In regard to any image density non-uniformity caused by blotches, it was excluded from the evaluation here. The evaluation on density non-uniformity was made according to the following criteria.

A: Any density non-uniformity can not be seen at all both on images and on the sleeve.

B: Slight density differences can be seen on halftone images. Any density differences can not be seen on solid black images.

C: Slight density differences are seen on solid black images. Some belt-shaped ones perceivable of density differences are seen on halftone images.

D: Belt-shaped density differences clearly measurable with the reflection densitometer appear on halftone images, and density differences can be seen also on solid black images.

(D) Blotches:

Halftone images and solid black images were reproduced, and, on these images, whether or not any blotches appeared was observed with the naked eye, which blotches tend to come about when the toner stood charged in excess. Results obtained on these are evaluated according to the following criteria.

A: Any blotch is not seen at all both on halftone images and on the sleeve.

B: Blotches are slightly seen on the sleeve, but at such a level that they do not affect any images.

C: Blotches are visually seen on halftone images, but can not be seen on solid black images.

D: Clear density differences can be seen both on halftone images and on solid black images.

Examples 2 to 45 & Comparative Examples 1 to 14

Developer Carrying Members E-2 to E-45, F-46 to F-59

Developer carrying members E-2 to E-45 (Examples 2 to 45) and developer carrying members F-46 to F-59 (Comparative Examples 1 to 14) were produced in the same way as that in Example 1 except that components shown in Table 12 below were used. The developer carrying members obtained were incorporated to obtain developing assemblies, and images were evaluated in the same way. Results obtained are shown in Tables 13-1 to 13-3.

TABLE 12

| | Acrylic resin | | Binder resin | | Electroconductive particles 1 | | Electroconductive particles 2 | | UPP |
|---|---|---|---|---|---|---|---|---|---|
| DCM | Type | pbm* | Type | pbm* | Type | pbm | Type | pbm | pbm |
| E-1 | A-1 | 10 | B-1 | 100 | C-1 | 4 | C-2 | 36 | 10 |
| E-2 | A-2 | 10 | B-1 | 100 | C-1 | 4 | C-2 | 36 | 10 |
| E-3 | A-3 | 10 | B-1 | 100 | C-1 | 4 | C-2 | 36 | 10 |
| E-4 | A-4 | 10 | B-1 | 100 | C-1 | 4 | C-2 | 36 | 10 |
| E-5 | A-5 | 10 | B-1 | 100 | C-1 | 4 | C-2 | 36 | 10 |
| E-6 | A-6 | 10 | B-1 | 100 | C-1 | 4 | C-2 | 36 | 10 |
| E-7 | A-7 | 10 | B-1 | 100 | C-1 | 4 | C-2 | 36 | 10 |
| E-8 | A-8 | 10 | B-1 | 100 | C-1 | 4 | C-2 | 36 | 10 |
| E-9 | A-9 | 10 | B-1 | 100 | C-1 | 4 | C-2 | 36 | 10 |
| E-10 | A-10 | 10 | B-1 | 100 | C-1 | 4 | C-2 | 36 | 10 |
| E-11 | A-11 | 10 | B-1 | 100 | C-1 | 4 | C-2 | 36 | 10 |
| E-12 | A-12 | 10 | B-1 | 100 | C-1 | 4 | C-2 | 36 | 10 |
| E-13 | A-13 | 10 | B-1 | 100 | C-1 | 4 | C-2 | 36 | 10 |
| E-14 | A-14 | 10 | B-1 | 100 | C-1 | 4 | C-2 | 36 | 10 |
| E-15 | A-15 | 10 | B-1 | 100 | C-1 | 4 | C-2 | 36 | 10 |
| E-16 | A-16 | 10 | B-1 | 100 | C-1 | 4 | C-2 | 36 | 10 |
| E-17 | A-17 | 10 | B-1 | 100 | C-1 | 4 | C-2 | 36 | 10 |
| E-18 | A-18 | 10 | B-1 | 100 | C-1 | 4 | C-2 | 36 | 10 |
| E-19 | A-1 | 10 | B-3 | 100 | C-1 | 4 | C-2 | 36 | 10 |
| E-20 | A-1 | 10 | B-2 | 100 | C-1 | 4 | C-2 | 36 | 10 |
| E-21 | A-1 | 0.5 | B-1 | 100 | C-1 | 4 | C-2 | 36 | 10 |
| E-22 | A-1 | 1 | B-1 | 100 | C-1 | 4 | C-2 | 36 | 10 |
| E-23 | A-1 | 30 | B-1 | 100 | C-1 | 4 | C-2 | 36 | 10 |
| E-24 | A-1 | 40 | B-1 | 100 | C-1 | 4 | C-2 | 36 | 10 |
| E-25 | A-19 | 10 | B-1 | 100 | C-1 | 4 | C-2 | 36 | 10 |
| E-26 | A-20 | 10 | B-1 | 100 | C-1 | 4 | C-2 | 36 | 10 |
| E-27 | A-21 | 10 | B-1 | 100 | C-1 | 4 | C-2 | 36 | 10 |
| E-28 | A-22 | 10 | B-1 | 100 | C-1 | 4 | C-2 | 36 | 10 |
| E-29 | A-23 | 10 | B-3 | 100 | C-1 | 4 | C-2 | 36 | 10 |
| E-30 | A-24 | 10 | B-1 | 100 | C-1 | 4 | C-2 | 36 | 10 |
| E-31 | A-25 | 10 | B-1 | 100 | C-1 | 4 | C-2 | 36 | 10 |
| E-32 | A-26 | 10 | B-1 | 100 | C-1 | 4 | C-2 | 36 | 10 |
| E-33 | A-27 | 10 | B-2 | 100 | C-1 | 4 | C-2 | 36 | 10 |
| E-34 | A-28 | 10 | B-1 | 100 | C-1 | 4 | C-2 | 36 | 10 |
| E-35 | A-29 | 10 | B-1 | 100 | C-1 | 4 | C-2 | 36 | 10 |
| E-36 | A-30 | 10 | B-1 | 100 | C-1 | 4 | C-2 | 36 | 10 |
| E-37 | A-31 | 10 | B-1 | 100 | C-1 | 4 | C-2 | 36 | 10 |
| E-38 | A-32 | 10 | B-1 | 100 | C-1 | 4 | C-2 | 36 | 10 |
| E-39 | A-33 | 10 | B-1 | 100 | C-1 | 4 | C-2 | 36 | 10 |
| E-40 | A-9 | 0.5 | B-1 | 100 | C-1 | 4 | C-2 | 36 | 10 |
| E-41 | A-17 | 1 | B-1 | 100 | C-1 | 4 | C-2 | 36 | 10 |
| E-42 | A-30 | 1 | B-1 | 100 | C-1 | 4 | C-2 | 36 | 10 |
| E-43 | A-21 | 30 | B-1 | 100 | C-1 | 4 | C-2 | 36 | 10 |
| E-44 | A-5 | 30 | B-1 | 100 | C-1 | 4 | C-2 | 36 | 10 |
| E-45 | A-31 | 40 | B-1 | 100 | C-1 | 4 | C-2 | 36 | 10 |
| E-46 | — | — | B-1 | 100 | C-1 | 4 | C-2 | 36 | 10 |
| E-47 | A-34 | 10 | B-1 | 100 | C-1 | 4 | C-2 | 36 | 10 |
| E-48 | A-35 | 10 | B-1 | 100 | C-1 | 4 | C-2 | 36 | 10 |
| E-49 | A-36 | 10 | B-1 | 100 | C-1 | 4 | C-2 | 36 | 10 |
| E-50 | A-37 | 10 | B-1 | 100 | C-1 | 4 | C-2 | 36 | 10 |
| E-51 | A-38 | 10 | B-1 | 100 | C-1 | 4 | C-2 | 36 | 10 |
| E-52 | A-39 | 10 | B-1 | 100 | C-1 | 4 | C-2 | 36 | 10 |
| E-53 | A-40 | 10 | B-1 | 100 | C-1 | 4 | C-2 | 36 | 10 |
| E-54 | A-41 | 10 | B-1 | 100 | C-1 | 4 | C-2 | 36 | 10 |
| E-55 | A-42 | 10 | B-1 | 100 | C-1 | 4 | C-2 | 36 | 10 |
| E-56 | A-43 | 10 | B-1 | 100 | C-1 | 4 | C-2 | 36 | 10 |
| E-57 | A-44 | 10 | B-1 | 100 | C-1 | 4 | C-2 | 36 | 10 |
| E-58 | A-45 | 10 | B-1 | 100 | C-1 | 4 | C-2 | 36 | 10 |
| E-59 | A-1 | 10 | B-4 | 100 | C-1 | 4 | C-2 | 36 | 10 |

*(solid content)

DCM: Developer carrying member UPP: Unevenness-providing particles

TABLE 13-1

| | | Image density | | | | | | | | | | | |
|---|---|---|---|---|---|---|---|---|---|---|---|---|---|
| | Developer carrying | Initial stage | | | After 500,000 sheets | | | Density difference | | | Image evaluation Initial stage | | |
| Example: | member | NL | NN | HH | NL | NN | HH | NL | NN | HH | NL | NN | HH |
| 1 | E-1 | 1.51 | 1.49 | 1.45 | 1.5 | 1.46 | 1.41 | 0.01 | 0.03 | 0.04 | A | A | A |
| 2 | E-2 | 1.5 | 1.49 | 1.44 | 1.49 | 1.45 | 1.41 | 0.01 | 0.04 | 0.03 | A | A | A |
| 3 | E-3 | 1.51 | 1.48 | 1.45 | 1.46 | 1.44 | 1.39 | 0.05 | 0.04 | 0.06 | A | A | B |
| 4 | E-4 | 1.5 | 1.5 | 1.46 | 1.45 | 1.44 | 1.4 | 0.05 | 0.06 | 0.06 | A | A | B |
| 5 | E-5 | 1.51 | 1.5 | 1.45 | 1.5 | 1.45 | 1.41 | 0.01 | 0.05 | 0.04 | A | A | A |
| 6 | E-6 | 1.39 | 1.33 | 1.3 | 1.35 | 1.31 | 1.28 | 0.04 | 0.02 | 0.02 | A | B | B |
| 7 | E-7 | 1.47 | 1.42 | 1.36 | 1.41 | 1.36 | 1.34 | 0.06 | 0.06 | 0.02 | A | A | B |
| 8 | E-8 | 1.5 | 1.48 | 1.46 | 1.43 | 1.43 | 1.4 | 0.07 | 0.05 | 0.06 | A | A | B |
| 9 | E-9 | 1.52 | 1.51 | 1.5 | 1.37 | 1.36 | 1.35 | 0.15 | 0.15 | 0.15 | A | A | A |
| 10 | E-10 | 1.51 | 1.5 | 1.47 | 1.44 | 1.44 | 1.41 | 0.07 | 0.06 | 0.06 | A | A | B |
| 11 | E-11 | 1.46 | 1.42 | 1.39 | 1.41 | 1.38 | 1.34 | 0.05 | 0.04 | 0.05 | A | A | A |
| 12 | E-12 | 1.41 | 1.37 | 1.32 | 1.35 | 1.31 | 1.3 | 0.06 | 0.06 | 0.02 | A | B | B |
| 13 | E-13 | 1.42 | 1.36 | 1.31 | 1.37 | 1.32 | 1.29 | 0.05 | 0.04 | 0.02 | A | B | B |
| 14 | E-14 | 1.5 | 1.47 | 1.44 | 1.48 | 1.44 | 1.4 | 0.02 | 0.03 | 0.04 | A | A | A |
| 15 | E-15 | 1.38 | 1.34 | 1.3 | 1.35 | 1.31 | 1.28 | 0.03 | 0.03 | 0.02 | A | B | B |
| 16 | E-16 | 1.39 | 1.38 | 1.34 | 1.38 | 1.32 | 1.3 | 0.01 | 0.06 | 0.04 | A | A | B |
| 17 | E-17 | 1.52 | 1.5 | 1.49 | 1.45 | 1.43 | 1.4 | 0.07 | 0.07 | 0.09 | A | A | A |
| 18 | E-18 | 1.52 | 1.52 | 1.5 | 1.41 | 1.4 | 1.39 | 0.11 | 0.12 | 0.11 | B | B | A |
| 19 | E-19 | 1.5 | 1.49 | 1.45 | 1.45 | 1.44 | 1.39 | 0.05 | 0.05 | 0.06 | A | A | A |
| 20 | E-20 | 1.5 | 1.5 | 1.44 | 1.46 | 1.44 | 1.4 | 0.04 | 0.06 | 0.04 | A | A | A |

| | Image evaluation | | | Density non-uniformity | | | | | | | | |
|---|---|---|---|---|---|---|---|---|---|---|---|---|
| | After 500,000 sheets | | | Initial stage | | | After 500,000 sheets | | | Blotches | | |
| Example: | NL | NN | HH | NL | NN | HH | NL | NN | HH | NL | NN | HH |
| 1 | A | A | A | A | A | A | A | A | A | A | A | A |
| 2 | A | A | B | A | A | A | A | A | A | A | A | A |
| 3 | A | A | B | B | B | B | B | B | B | A | A | A |
| 4 | A | A | B | B | B | B | B | B | B | B | A | A |
| 5 | A | A | A | A | A | A | A | A | A | A | A | A |
| 6 | B | B | B | A | A | A | A | A | A | A | A | A |
| 7 | A | A | B | A | A | A | A | A | B | A | A | A |
| 8 | A | A | B | B | B | B | A | A | B | B | A | A |
| 9 | A | A | B | A | A | A | A | A | B | B | A | A |
| 10 | A | A | B | B | B | B | B | B | B | B | A | A |
| 11 | A | A | B | A | A | A | A | A | B | A | A | A |
| 12 | B | B | B | A | B | B | B | B | B | A | A | A |
| 13 | B | B | B | A | B | B | B | B | B | A | A | A |
| 14 | A | A | A | A | A | A | A | A | A | A | A | A |
| 15 | B | B | B | A | A | A | A | A | A | A | A | A |
| 16 | A | A | B | A | A | A | A | A | A | A | A | A |
| 17 | A | A | B | B | B | A | B | B | B | A | A | A |
| 18 | B | B | B | B | B | B | B | B | B | B | A | A |
| 19 | A | A | B | B | B | B | B | B | B | A | A | A |
| 20 | A | A | B | B | B | B | B | B | B | A | A | A |

TABLE 13-2

| | | Image density | | | | | | | | | | | |
|---|---|---|---|---|---|---|---|---|---|---|---|---|---|
| | Developer carrying | Initial stage | | | After 500,000 sheets | | | Density difference | | | Image evaluation Initial stage | | |
| Example: | member | NL | NN | HH | NL | NN | HH | NL | NN | HH | NL | NN | HH |
| 21 | E-21 | 1.35 | 1.33 | 1.3 | 1.31 | 1.3 | 1.28 | 0.04 | 0.03 | 0.02 | B | B | B |
| 22 | E-22 | 1.38 | 1.35 | 1.31 | 1.36 | 1.32 | 1.3 | 0.02 | 0.03 | 0.01 | A | A | B |
| 23 | E-23 | 1.5 | 1.49 | 1.47 | 1.48 | 1.48 | 1.44 | 0.02 | 0.01 | 0.03 | B | B | B |
| 24 | E-24 | 1.51 | 1.49 | 1.49 | 1.49 | 1.48 | 1.45 | 0.02 | 0.01 | 0.04 | B | B | B |
| 25 | E-25 | 1.38 | 1.34 | 1.3 | 1.32 | 1.3 | 1.29 | 0.06 | 0.04 | 0.01 | A | B | B |
| 26 | E-26 | 1.49 | 1.48 | 1.44 | 1.44 | 1.41 | 1.39 | 0.05 | 0.07 | 0.05 | A | B | B |
| 27 | E-27 | 1.42 | 1.37 | 1.31 | 1.33 | 1.3 | 1.28 | 0.09 | 0.07 | 0.03 | A | B | B |
| 28 | E-28 | 1.5 | 1.48 | 1.48 | 1.41 | 1.41 | 1.39 | 0.09 | 0.07 | 0.09 | B | B | B |
| 29 | E-29 | 1.39 | 1.35 | 1.31 | 1.31 | 1.3 | 1.29 | 0.08 | 0.05 | 0.02 | A | B | B |
| 30 | E-30 | 1.5 | 1.47 | 1.46 | 1.41 | 1.37 | 1.36 | 0.09 | 0.1 | 0.1 | B | B | B |
| 31 | E-31 | 1.44 | 1.41 | 1.36 | 1.35 | 1.32 | 1.29 | 0.09 | 0.09 | 0.07 | A | A | A |
| 32 | E-32 | 1.46 | 1.42 | 1.41 | 1.4 | 1.37 | 1.34 | 0.06 | 0.05 | 0.07 | B | B | B |

TABLE 13-2-continued

| | | | | | | | | | | | | | |
|---|---|---|---|---|---|---|---|---|---|---|---|---|---|
| 33 | E-33 | 1.45 | 1.39 | 1.36 | 1.39 | 1.32 | 1.3 | 0.06 | 0.07 | 0.06 | A | A | B |
| 34 | E-34 | 1.49 | 1.48 | 1.44 | 1.37 | 1.37 | 1.35 | 0.12 | 0.11 | 0.09 | A | A | A |
| 35 | E-35 | 1.41 | 1.35 | 1.31 | 1.36 | 1.31 | 1.28 | 0.05 | 0.04 | 0.03 | A | A | B |
| 36 | E-36 | 1.43 | 1.38 | 1.34 | 1.39 | 1.33 | 1.3 | 0.04 | 0.05 | 0.04 | A | B | B |
| 37 | E-37 | 1.38 | 1.33 | 1.29 | 1.34 | 1.3 | 1.28 | 0.04 | 0.03 | 0.01 | A | B | B |
| 38 | E-38 | 1.38 | 1.38 | 1.34 | 1.37 | 1.32 | 1.29 | 0.01 | 0.06 | 0.05 | A | A | B |
| 39 | E-39 | 1.47 | 1.41 | 1.37 | 1.41 | 1.37 | 1.33 | 0.06 | 0.04 | 0.04 | A | B | B |
| 40 | E-40 | 1.43 | 1.4 | 1.37 | 1.32 | 1.31 | 1.31 | 0.11 | 0.09 | 0.06 | B | B | B |
| 41 | E-41 | 1.4 | 1.38 | 1.34 | 1.35 | 1.32 | 1.3 | 0.05 | 0.06 | 0.04 | A | A | A |
| 42 | E-42 | 1.35 | 1.33 | 1.29 | 1.32 | 1.3 | 1.28 | 0.03 | 0.03 | 0.01 | B | B | B |
| 43 | E-43 | 1.45 | 1.41 | 1.39 | 1.41 | 1.37 | 1.36 | 0.04 | 0.04 | 0.03 | B | B | B |
| 44 | E-44 | 1.5 | 1.49 | 1.47 | 1.48 | 1.48 | 1.43 | 0.02 | 0.01 | 0.04 | B | B | B |
| 45 | E-45 | 1.39 | 1.35 | 1.31 | 1.39 | 1.34 | 1.3 | 0 | 0.01 | 0.01 | B | B | B |

| | Image evaluation | | | Density non-uniformity | | | | | | | | |
|---|---|---|---|---|---|---|---|---|---|---|---|---|
| | After 500,000 sheets | | | Initial stage | | | After 500,000 sheets | | | Blotches | | |
| Example: | NL | NN | HH | NL | NN | HH | NL | NN | HH | NL | NN | HH |
| 21 | B | B | C | A | A | A | A | A | A | A | A | A |
| 22 | B | B | B | A | A | A | A | A | A | A | A | A |
| 23 | B | B | B | B | A | A | B | A | A | A | A | A |
| 24 | B | B | B | B | B | B | B | B | B | B | A | A |
| 25 | B | B | C | B | B | B | B | B | B | A | A | A |
| 26 | B | B | B | B | B | B | B | B | B | A | A | A |
| 27 | B | B | C | B | B | B | B | B | B | A | A | A |
| 28 | B | B | C | B | B | B | B | B | B | B | A | A |
| 29 | B | B | B | B | B | B | B | B | B | A | A | A |
| 30 | B | B | B | B | B | B | B | B | B | A | A | A |
| 31 | B | B | B | B | B | B | B | B | B | A | A | A |
| 32 | B | B | B | B | B | B | B | B | B | A | A | A |
| 33 | A | A | B | B | B | B | B | B | B | A | A | A |
| 34 | A | A | B | A | A | A | A | A | B | B | A | A |
| 35 | A | B | B | B | B | B | B | B | B | A | A | A |
| 36 | B | B | B | B | A | A | B | A | B | A | A | A |
| 37 | B | B | B | A | A | A | A | A | A | A | A | A |
| 38 | A | A | B | A | A | A | A | A | A | A | A | A |
| 39 | B | B | B | B | B | B | B | B | B | A | A | A |
| 40 | B | B | C | A | A | A | A | A | B | A | A | A |
| 41 | A | A | B | B | B | A | B | B | B | A | A | A |
| 42 | B | B | B | B | B | A | B | B | B | A | A | A |
| 43 | B | B | B | B | B | B | B | B | B | A | A | A |
| 44 | B | B | B | B | A | A | B | A | A | A | A | A |
| 45 | B | B | B | B | B | B | B | B | B | A | A | A |

TABLE 13-3

| | | Image density | | | | | | | | | | | |
|---|---|---|---|---|---|---|---|---|---|---|---|---|---|
| Comparative | Developer carrying | Initial stage | | | After 500,000 sheets | | | Density difference | | | Image evaluation Initial stage | | |
| Example: | member | NL | NN | HH | NL | NN | HH | NL | NN | HH | NL | NN | HH |
| 1 | F-46 | 1.31 | 1.25 | 1.19 | 1.2 | 1.14 | 1.09 | 0.11 | 0.11 | 0.1 | C | C | C |
| 2 | F-47 | 1.34 | 1.29 | 1.23 | 1.21 | 1.18 | 1.1 | 0.13 | 0.11 | 0.13 | C | D | D |
| 3 | F-48 | 1.36 | 1.3 | 1.25 | 1.22 | 1.2 | 1.14 | 0.14 | 0.1 | 0.11 | C | C | C |
| 4 | F-49 | 1.35 | 1.29 | 1.23 | 1.21 | 1.19 | 1.14 | 0.14 | 0.1 | 0.09 | C | C | C |
| 5 | F-50 | 1.32 | 1.27 | 1.22 | 1.21 | 1.18 | 1.13 | 0.11 | 0.09 | 0.09 | C | C | C |
| 6 | F-51 | 1.33 | 1.27 | 1.22 | 1.22 | 1.2 | 1.14 | 0.11 | 0.07 | 0.08 | C | C | C |
| 7 | F-52 | 1.52 | 1.52 | 1.5 | 1.31 | 1.26 | 1.22 | 0.21 | 0.26 | 0.28 | C | B | B |
| 8 | F-53 | 1.34 | 1.27 | 1.21 | 1.22 | 1.2 | 1.16 | 0.12 | 0.07 | 0.05 | C | C | C |
| 9 | F-54 | 1.32 | 1.26 | 1.22 | 1.2 | 1.16 | 1.06 | 0.12 | 0.1 | 0.16 | D | D | D |
| 10 | F-55 | 1.32 | 1.2 | 1.14 | 1.19 | 1.11 | 1.03 | 0.13 | 0.09 | 0.11 | C | C | C |
| 11 | F-56 | 1.31 | 1.22 | 1.19 | 1.17 | 1.14 | 1.09 | 0.14 | 0.08 | 0.1 | C | C | C |
| 12 | F-57 | 1.52 | 1.52 | 1.5 | 1.17 | 1.14 | 1.11 | 0.35 | 0.38 | 0.39 | C | B | B |
| 13 | F-58 | 1.3 | 1.22 | 1.16 | 1.19 | 1.16 | 1.07 | 0.11 | 0.06 | 0.09 | C | C | C |
| 14 | F-59 | 1.51 | 1.49 | 1.46 | 1.01 | 0.97 | 0.92 | 0.5 | 0.52 | 0.54 | B | B | B |

TABLE 13-3-continued

| Comparative Example: | Image evaluation After 500,000 sheets NL | NN | HH | Density non-uniformity Initial stage NL | NN | HH | After 500,000 sheets NL | NN | HH | Blotches NL | NN | HH |
|---|---|---|---|---|---|---|---|---|---|---|---|---|
| 1 | C | D | D | B | B | B | B | B | C | A | A | A |
| 2 | D | D | D | D | D | D | D | D | D | A | A | A |
| 3 | C | C | D | D | D | D | D | D | D | A | A | A |
| 4 | C | C | D | D | D | D | D | D | D | B | A | A |
| 5 | C | C | D | B | B | B | B | B | B | A | A | A |
| 6 | C | C | D | B | B | B | B | B | B | A | A | A |
| 7 | C | C | C | D | D | D | D | D | D | C | A | A |
| 8 | C | C | D | B | B | B | B | B | B | A | A | A |
| 9 | D | D | D | C | C | B | C | C | C | A | A | A |
| 10 | C | D | D | D | D | D | D | D | D | A | A | A |
| 11 | C | D | D | B | B | B | B | B | C | A | A | A |
| 12 | C | C | D | D | D | D | D | D | D | D | B | A |
| 13 | C | C | D | B | B | B | B | B | C | A | A | A |
| 14 | D | D | D | A | A | A | D | D | D | B | A | A |

Example 46

Developer Carrying Member G-60

A developer carrying member G-60 was produced in the following way. First, materials shown in Table 14 below were mixed, and the mixture obtained was treated by means of a horizontal sand mill (using zirconia beads of 1.0 mm in diameter in a packing of 85%) to obtain a coating fluid.

TABLE 14

| | |
|---|---|
| Acrylic resin solution A-1 | Solid content: 7 parts by mass (17.5 parts by mass as solution) |
| Resin B-1 | Solid content: 100 parts by mass (166.7 parts by mass as solution) |
| Electroconductive particles C-1 | 6 parts by mass |
| Electroconductive particles C-2 | 54 parts by mass |
| Unevenness-providing particles | 10 parts by mass |
| Methanol | 200 parts by mass |

A cylindrical pipe made of aluminum and having an outer diameter of 20 mm (Ra: 0.4 μm; reference length (lr): 4 mm) was readied as a substrate. This substrate was masked at its both end portions by 6 mm each, and thereafter so placed that its axis was parallel to the vertical. Then, this substrate was rotated at 1,500 rpm, and was coated with the coating fluid while a spray gun was descended at 40 mm/second, to form a coating in such a way that it came to be 8 μm in thickness as a result of hardening. Subsequently, the coating was hardened by heating it for 30 minutes in a temperature 150° C. hot-air drying oven, to produce a developer carrying member, G-60. A magnet roller was incorporated to the developer carrying member G-60 obtained, and this developer carrying member was fitted, as a developing roller, to a pure cartridge of a printer (trade name: LASER JET 4350; manufactured by Hewlett-Packard Co.).

This cartridge was mounted to the above printer to make image evaluation as described below. The image evaluation was made in a normal-temperature and low-humidity environment (temperature 23° C., humidity 50% RH; N/N). Here, in this image evaluation, letter size sheets (trade name: BUSINESS 4200; available from Xerox Corporation; 75 g/m$^2$) were used, and character images with a print percentage of 3% were continuously reproduced on up to 50,000 sheets in A4-size longitudinal feed to test image reproduction. Image evaluation for the item (E) was made at the initial stage and after the 50,000-sheet image reproduction each. Image evaluation for the items (F)-(G) was made at the initial stage. Results obtained are shown in Table 6.

(E) Image Density:

Using a reflection densitometer (trade name: RD918; manufactured by Macbeth Co.), the density of solid black areas when solid black images were printed was measured at 5 spots, and an average value thereof was taken as the image density.

(F) Image Quality Evaluation:

A Chinese character image shown in FIG. 3, having a font size of 4 points, was reproduced, and any blurred images of the Chinese character and/or spots of toner around images were observed with the naked eye and with use of a magnifier (magnification: 10 times) to evaluate image quality according to the following criteria.

A: Neither blurred images of the Chinese character nor spots of toner around images of the Chinese character are seen even in observation with the magnifier.

B: Sharp images are seen in observation with the naked eye.

C: Spots of toner around images are somewhat seen on the Chinese character in observation with the naked eye.

D: Blurred images of the Chinese character are seen even in observation with the naked eye. Spots of toner around images are also seen on the Chinese character.

(G) Triboelectric Charge Quantity of Toner on Developer Carrying Member:

The toner carried on the developer carrying member was collected by suction through a metallic cylinder and a cylindrical filter, where the quantity Q of electric charges stored in a capacitor and the mass M of the toner sucked were measured. From the values of these, the charge quantity Q/M (μC/g) was calculated.

Examples 47, 48 & Comparative Example 15

Developer Carrying Members G-61, G-62, H-63

Developer carrying members G-61 and G-62 (Examples 47, 48) and a developer carrying member H-63 (Comparative Example 15) were produced in the same way as that in Example 46 except that components shown in Table 15 below were used. The developer carrying members obtained were incorporated to obtain developing assemblies, and images were evaluated in the same way. Results obtained are shown in Table 16.

TABLE 15

| Developer carrying member | Acrylic resin Type | Acrylic resin pbm (*) | Binder resin Type | Binder resin pbm (*) | Electroconductive particles 1 Type | Electroconductive particles 1 pbm | Electroconductive particles 2 Type | Electroconductive particles 2 pbm | Unevenness-providing particles pbm |
|---|---|---|---|---|---|---|---|---|---|
| G-60 | A-1 | 7 | B-1 | 100 | C-1 | 6 | C-2 | 54 | 10 |
| G-61 | A-12 | 7 | B-1 | 100 | C-1 | 6 | C-2 | 54 | 10 |
| G-62 | A-1 | 1 | B-1 | 100 | C-1 | 6 | C-2 | 54 | 10 |
| G-63 | — | — | B-1 | 100 | C-1 | 6 | C-2 | 54 | 10 |

(*) (solid content)

TABLE 16

| | Developer carrying member | Image density: Initial stage LL | Initial stage NN | Initial stage HH | After 50,000 sheets LL | After 50,000 sheets NN | After 50,000 sheets HH | Density difference LL | Density difference NN | Density difference HH | Image evaluation: Initial stage LL | Initial stage NN | Initial stage HH | After 50,000 sheets LL | After 50,000 sheets NN | After 50,000 sheets HH | Charge quantity LL | Charge quantity NN | Charge quantity HH |
|---|---|---|---|---|---|---|---|---|---|---|---|---|---|---|---|---|---|---|---|
| Example: | | | | | | | | | | | | | | | | | | | |
| 46 | G-60 | 1.48 | 1.46 | 1.43 | 1.41 | 1.40 | 1.37 | 0.07 | 0.06 | 0.06 | A | A | A | A | A | A | 8.9 | 8.2 | 7.5 |
| 47 | G-61 | 1.42 | 1.40 | 1.38 | 1.36 | 1.34 | 1.33 | 0.06 | 0.06 | 0.05 | B | B | B | B | B | B | 8.7 | 7.9 | 7.1 |
| 48 | G-62 | 1.37 | 1.36 | 1.34 | 1.32 | 1.31 | 1.29 | 0.05 | 0.05 | 0.05 | B | B | B | B | B | C | 8.2 | 7.5 | 6.8 |
| Comparative Example: | | | | | | | | | | | | | | | | | | | |
| 15 | H-63 | 1.31 | 1.29 | 1.24 | 1.11 | 1.08 | 1.06 | 0.20 | 0.21 | 0.18 | C | C | C | C | D | D | 7.4 | 6.8 | 5.9 |

According to the present invention, a developer carrying member can be obtained which can improve the ability to provide the toner with triboelectric charges and, as a result thereof, can keep image density decrease, density non-uniformity or spots of toner around images from occurring in electrophotographic images. More specifically, the effect of presence of a long-chain alkyl group or long-chain hydroxyalkyl group in a cationic unit (2) represented by Formula (2) brings an improvement in charge-providing ability to the toner. Also, the effect of presence of a long-chain alkyl group in an ester unit (1) represented by Formula (1) makes the acrylic resin so well compatible with the thermosetting resin as to be able to be uniformly present in the resin layer.

REFERENCE SIGNS LIST

101, 201, 301: resin layer
102, 202, 302: substrate
103, 203: developing sleeve
303: developing sleeve (developer carrying member)
104, 204: magnet roller
105, 205: developer carrying member
106, 206, 306: photosensitive drum (electrostatic latent image bearing member)
107: magnetic blade (developer layer thickness control member)
215, 315: elastic blade (developer layer thickness control member)
317: non-magnetic one-component developer While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-297565, filed Dec. 28, 2009, which is hereby incorporated by reference herein in its entirety.

What is claimed is:

1. A developer carrying member comprising a substrate and a resin layer; wherein said resin layer comprises a thermosetting resin, an acrylic resin having a unit represented by Formula (1) and a unit represented by Formula (2), and electroconductive particles:

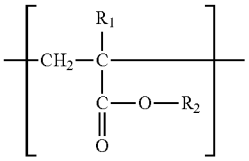

(1)

where, in Formula (1), $R_1$ represents a hydrogen atom or a methyl group, and $R_2$ represents an alkyl group having 8 to 18 carbon atoms; and (2)

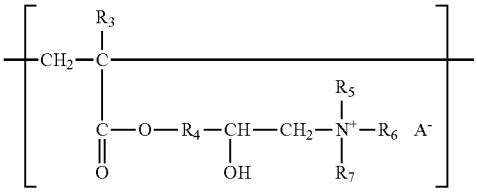

where, in Formula (2), $R_3$ represents a hydrogen atom or a methyl group; $R_4$ represents an alkylene group having 1 to 4 carbon atom(s); one or two or more groups of $R_5$ to $R_7$ represents or each independently represent any group selected from an alkyl group having 4 to 18 carbon atoms and a hydroxyalkyl group having 4 to 18 carbon atoms; of these $R_5$ to $R_7$, a group or groups which is/are not the alkyl group(s) having 4 to 18 carbon atoms or hydroxyalkyl group(s) having 4 to 18 carbon atoms represents or each independently represent any group selected from an alkyl group having 1 to 3 carbon atom(s) and a hydroxyalkyl group having 1 to 3 carbon atom(s); and $A^-$ represents an anion.

2. The developer carrying member according to claim 1, wherein the anion in the unit (2) is a methylsulfonate ion or a p-toluenesulfonate ion.

3. The developer carrying member according to claim 1, wherein, where the number of moles of the unit (1) in the acrylic resin is represented by A and the number of moles of the unit (2) therein is represented by B, the value of B/(A+B) is from 0.2 or more to 0.8 or less.

4. The developer carrying member according to claim 1, wherein the acrylic resin is contained in the resin layer within the range of from 1 part by mass or more to 30 parts by mass or less, based on 100 parts by mass of the thermosetting resin.

5. A developing assembly comprising:

a negatively chargeable developer having toner particles;

a container holding the developer therein; and a developer carrying member for carrying and transporting thereon the developer held in the container; and wherein the developing assembly transports, while forming a developer layer on the developer carrying member by means of a developer layer thickness control member, the developer on the developer carrying member to a developing area facing an electrostatic latent image bearing member and develops an electrostatic latent image the electrostatic latent image bearing member has; and the developer carrying member is the developer carrying member according to claim 1.

* * * * *